US010319305B2

(12) United States Patent
Kishi et al.

(10) Patent No.: US 10,319,305 B2
(45) Date of Patent: Jun. 11, 2019

(54) DISPLAY DEVICE AND DRIVE METHOD THEREFOR

(71) Applicant: SHARP KABUSHIKI KAISHA, Sakai, Osaka (JP)

(72) Inventors: Noritaka Kishi, Sakai (JP); Hiroyuki Furukawa, Sakai (JP); Katsuya Otoi, Sakai (JP); Kazuyoshi Yoshiyama, Sakai (JP); Tamotsu Sakai, Sakai (JP); Naoko Gotoh, Sakai (JP)

(73) Assignee: SHARP KABUSHIKI KAISHA, Sakai, Osaka (JP)

( * ) Notice: Subject to any disclaimer, the term of this patent is extended or adjusted under 35 U.S.C. 154(b) by 0 days.

(21) Appl. No.: 15/550,117

(22) PCT Filed: Feb. 3, 2016

(86) PCT No.: PCT/JP2016/053154
§ 371 (c)(1),
(2) Date: Aug. 10, 2017

(87) PCT Pub. No.: WO2016/129463
PCT Pub. Date: Aug. 18, 2016

(65) Prior Publication Data

US 2018/0033372 A1 Feb. 1, 2018

(30) Foreign Application Priority Data

Feb. 10, 2015 (JP) ..... 2015-024601

(51) Int. Cl.
*G09G 3/3258* (2016.01)
*G09G 3/20* (2006.01)
(Continued)

(52) U.S. Cl.
CPC ..... *G09G 3/3258* (2013.01); *G09G 3/20* (2013.01); *G09G 3/30* (2013.01); *G09G 3/3233* (2013.01);
(Continued)

(58) Field of Classification Search
CPC ..... G09G 2300/0842; G09G 2320/029; G09G 2320/0295; G09G 2320/045;
(Continued)

(56) References Cited

U.S. PATENT DOCUMENTS

2003/0011314 A1 1/2003 Numao et al.
2008/0030438 A1 2/2008 Marx et al.
(Continued)

FOREIGN PATENT DOCUMENTS

JP H11-316366 A 11/1999
JP 2002-341825 A 11/2002
(Continued)

*Primary Examiner* — Dmitriy Bolotin
(74) *Attorney, Agent, or Firm* — ScienBiziP, P.C.

(57) ABSTRACT

A current measurement circuit measures a current flowing through a drive transistor when a plurality of measurement voltages are written to a pixel circuit in a switching manner, and a current flowing through an organic EL element when another plurality of measurement voltages are written to the pixel circuit in a switching manner. A correction unit obtains a threshold voltage and a gain of the drive transistor and the organic EL element with respect to each pixel circuit based on a measured current, determines in which operation region the drive transistor operates between a saturation region and a triode region with respect to each pixel circuit based on the video signal, and corrects the video signal in accordance with the operation region of the drive transistor. Since the drive transistor operates both in the saturation region and the triode region, it is possible to reduce a power supply voltage and reduce power consumption of a display device.

15 Claims, 12 Drawing Sheets

(51) Int. Cl.

| | |
|---|---|
| ***G09G 3/30*** | (2006.01) |
| ***G09G 3/3266*** | (2016.01) |
| ***G09G 3/3291*** | (2016.01) |
| ***G09G 3/3233*** | (2016.01) |

(52) U.S. Cl.
CPC ..... *G09G 3/3266* (2013.01); *G09G 3/3291* (2013.01); *G09G 2300/0842* (2013.01); *G09G 2320/029* (2013.01); *G09G 2320/0295* (2013.01); *G09G 2320/045* (2013.01); *G09G 2320/0693* (2013.01); *G09G 2330/023* (2013.01)

(58) Field of Classification Search
CPC ..... G09G 2320/0693; G09G 2330/023; G09G 3/20; G09G 3/30; G09G 3/3233; G09G 3/3258; G09G 3/3266; G09G 3/3291; H01L 51/50
See application file for complete search history.

(56) References Cited

U.S. PATENT DOCUMENTS

| | | | | |
|---|---|---|---|---|
| 2008/0055223 | A1* | 3/2008 | Stewart | G09G 3/325 345/92 |
| 2008/0062090 | A1* | 3/2008 | Stewart | G09G 3/325 345/76 |
| 2008/0062091 | A1* | 3/2008 | Stewart | G09G 3/3241 345/76 |
| 2009/0244047 | A1 | 10/2009 | Mizutani et al. | |
| 2010/0214273 | A1 | 8/2010 | Shirouzu et al. | |
| 2011/0303821 | A1* | 12/2011 | Chiang | H01L 27/14679 250/208.1 |
| 2011/0303825 | A1* | 12/2011 | Kung | G01J 1/4228 250/208.2 |
| 2011/0304598 | A1* | 12/2011 | Kung | G06F 3/0412 345/207 |
| 2016/0300534 | A1 | 10/2016 | Kishi | |

FOREIGN PATENT DOCUMENTS

| | | | |
|---|---|---|---|
| JP | 2005-300929 | A | 10/2005 |
| JP | 2007-316356 | A | 12/2007 |
| JP | 2007-536585 | A | 12/2007 |
| JP | 2009-8799 | A | 1/2009 |
| JP | 2009-244654 | A | 10/2009 |
| JP | 2010-281874 | A | 12/2010 |
| JP | 2011-169992 | A | 9/2011 |
| WO | 2007/090287 | A1 | 8/2007 |
| WO | 2010/001590 | A1 | 1/2010 |
| WO | 2010/0101761 | A1 | 9/2010 |
| WO | 2015/093097 | A1 | 6/2015 |

* cited by examiner

DISPLAY DEVICE AND DRIVE METHOD THEREFOR

TECHNICAL FIELD

The present invention relates to a display device, especially to a display device having a pixel circuit including an electro-optical element such as an organic EL element, and a drive method therefor.

BACKGROUND ART

In recent years, an organic EL (Electro Luminescence) display device has been attracting attention as a thin, lightweight, fast-response display device. The organic EL display device includes a plurality of pixel circuits arranged two-dimensionally. The pixel circuit of the organic EL display device includes an organic EL element, and a drive transistor connected in series with the organic EL element. The drive transistor controls an amount of current flowing through the organic EL element, and the organic EL element emits light at brightness in accordance with the amount of the flowing current.

In a manufacturing process, variation occurs in characteristics of elements in the pixel circuit. Furthermore, the characteristics of the elements in the pixel circuit fluctuate with a passage of time. For example, characteristics of the drive transistor individually degrade in accordance with light emission brightness and light emission time. The same holds true for characteristics of the organic EL element. Thus, even when a same voltage is applied to gate terminals of the drive transistors, variation occurs in the light emission brightness of the organic EL elements.

Thus, in order to perform high image quality display in the organic EL display device, there is known a method in which a video signal is corrected so that variation and fluctuation of the characteristics of the organic EL element and the drive transistor are compensated. For example, Patent Document 1 discloses an organic EL display device for compensating for the fluctuation of the characteristics of the organic EL element by measuring a voltage between terminals of the organic EL element when a detection current flows through the organic EL element, and correcting a video signal based on the measured voltage.

PRIOR ART DOCUMENT

Patent Document

[Patent Document 1] Japanese Laid-Open Patent Publication No. 2009-244654

SUMMARY OF THE INVENTION

Problems to be Solved by the Invention

The organic EL display device disclosed in Patent Document 1 performs analog gradation drive. In the analog gradation drive, a multi-gradation voltage in accordance with a video signal (hereinafter referred to as data voltage) is applied to the gate terminal of the drive transistor. Furthermore, in order to make a desired current flow through the organic EL element irrespective of the characteristics of the organic EL element, a power supply voltage and the data voltage supplied to the pixel circuit are determined so that the drive transistor operates in a saturation region. In order to make the drive transistor operate in the saturation region, when a voltage in an operation range is applied to the gate terminal, it is necessary to control a drain-source voltage to be not less than an overdrive voltage (a voltage obtained by subtracting a threshold voltage from a gate-source voltage).

In a conventional organic EL display device performing the analog gradation drive, even when a voltage corresponding to a maximum gradation is applied to the gate terminal of the drive transistor, it is necessary to control the drain-source voltage of the drive transistor to be not less than the overdrive voltage. However, the drain-source voltage of the drive transistor does not contribute to light emission of the organic EL element, and only becomes a reason for heat generation. Thus, the conventional organic EL display device performing the analog gradation drive has a problem that power consumption is large.

Apart from this, as a method for controlling the drive transistor to operate in a triode region, there is known time-division digital gradation drive in which one frame period is divided into a plurality of subframe periods and a two-level voltage in accordance with each bit of the video signal is applied to the gate terminal of the drive transistor in each subframe period. However, the organic EL display device performing the time-division digital gradation drive has a problem that high precision display is difficult because an operating frequency increases in accordance with the number of gradations. Furthermore, the organic EL display device performing the time-division digital gradation drive also has a problem that a pseudo contour occurs in a display screen, a lifetime of the organic EL element is short, and the like.

Accordingly, an object of the present invention is to provide a high image quality and low power consumption display device.

Means for Solving the Problems

According to a first aspect of the present invention, there is provided an active-matrix type display device including: a display unit including a plurality of scanning lines, a plurality of data lines, and a plurality of pixel circuits arranged two-dimensionally; a scanning line drive circuit configured to drive the scanning lines; and a data line drive circuit configured to drive the data lines, wherein the pixel circuit includes an electro-optical element, and a drive transistor having a control terminal and connected in series with the electro-optical element, and the drive transistor is configured to operate in a saturation region when a data voltage applied to the control terminal using the data line drive circuit is in a first range, and operate in a triode region when the data voltage is in a second range.

According to a second aspect of the present invention, in the first aspect of the present invention, the display device further includes: a measurement circuit provided at an outside of the display unit and configured to measure a current or a voltage with respect to the pixel circuit; and a correction unit configured to correct a video signal to be supplied to the data line drive circuit, based on the current or the voltage measured by the measurement circuit, wherein the correction unit is configured to determine in which operation region the drive transistor operates between the saturation region and the triode region with respect to each pixel circuit based on the video signal, and correct the video signal in accordance with the operation region of the drive transistor.

According to a third aspect of the present invention, in the second aspect of the present invention, the correction unit is configured to obtain characteristics of the drive transistor and the electro-optical element with respect to each pixel circuit based on the current or the voltage measured by the measurement circuit, and correct the video signal in accordance with the operation region of the drive transistor using the characteristics of the drive transistor and the electro-optical element.

According to a fourth aspect of the present invention, in the third aspect of the present invention, the correction unit is configured to obtain a first voltage to be applied to the drive transistor and a second voltage to be applied to the electro-optical element based on a code value included in the video signal, correct the second voltage using the characteristics of the electro-optical element, correct the first voltage using the characteristics of the drive transistor in accordance with the operation region of the drive transistor, and obtain a code value corresponding to a sum of a corrected first voltage and a corrected second voltage.

According to a fifth aspect of the present invention, in the fourth aspect of the present invention, the correction unit is configured to determine the operation region of the drive transistor based on the first voltage and the corrected second voltage, after correcting the second voltage.

According to a sixth aspect of the present invention, in the second aspect of the present invention, the display unit further includes a power supply electrode configured to supply a power supply voltage to the pixel circuit, and the display device further includes an operational amplifier having a non-inverting input terminal to which the power supply voltage is applied, an inverting input terminal connected to the power supply electrode, and an output terminal connected to the power supply electrode.

According to a seventh aspect of the present invention, in the second aspect of the present invention, the display device further includes a power supply control unit configured to control a level of the power supply voltage to be supplied to the pixel circuit.

According to an eighth aspect of the present invention, in the second aspect of the present invention, the measurement circuit is a current measurement circuit configured to measure a current flowing through the pixel circuit.

According to a ninth aspect of the present invention, in the eighth aspect of the present invention, the current measurement circuit is configured to measure a current flowing through the drive transistor when a plurality of measurement voltages are written to the pixel circuit in a switching manner, and a current flowing through the electro-optical element when another plurality of measurement voltages are written to the pixel circuit in a switching manner, and the correction unit is configured to obtain a threshold voltage and a gain of the drive transistor and a threshold voltage and a gain of the electro-optical element with respect to each pixel circuit based on the current measured by the current measurement circuit.

According to a tenth aspect of the present invention, in the eighth aspect of the present invention, the pixel circuit further includes: a write control transistor having a first conduction terminal connected to the data line, a second conduction terminal connected to the control terminal of the drive transistor, and a control terminal connected to a first scanning line in the scanning lines; and a read control transistor having a first conduction terminal connected to the data line, a second conduction terminal connected to a connection point of the drive transistor and the electro-optical element, and a control terminal connected to a second scanning line in the scanning lines, and the current measurement circuit is connected to the data line and is configured to measure the current flowing through the pixel circuit and the data line.

According to an eleventh aspect of the present invention, in the eighth aspect of the present invention, the display unit further includes a plurality of monitor lines, the pixel circuit further includes: a write control transistor having a first conduction terminal connected to the data line, a second conduction terminal connected to the control terminal of the drive transistor, and a control terminal connected to the scanning line; and a read control transistor having a first conduction terminal connected to the monitor line, a second conduction terminal connected to a connection point of the drive transistor and the electro-optical element, and a control terminal connected to the scanning line, and the current measurement circuit is connected to the monitor line and is configured to measure the current flowing through the pixel circuit and the monitor line.

According to a twelfth aspect of the present invention, in the eighth aspect of the present invention, the display unit includes a power supply line, the pixel circuit further includes a write control transistor having a first conduction terminal connected to the data line, a second conduction terminal connected to the control terminal of the drive transistor, and a control terminal connected to the scanning line, the first conduction terminal of the drive transistor is connected to the power supply line, and the current measurement circuit is connected to the power supply line and is configured to measure the current flowing through the pixel circuit and the power supply line.

According to a thirteenth aspect of the present invention, in the second aspect of the present invention, the measurement circuit is a voltage measurement circuit configured to measure a voltage of a node in the pixel circuit.

According to a fourteenth aspect of the present invention, in the thirteenth aspect of the present invention, the voltage measurement circuit is configured to measure a voltage of one conduction terminal of the drive transistor when a plurality of measurement currents flow through the drive transistor in a switching manner, and a voltage of one terminal of the electro-optical element when another plurality of measurement currents flow through the electro-optical element in a switching manner, and the correction unit is configured to obtain a threshold voltage and a gain of the drive transistor and a threshold voltage and a gain of the electro-optical element with respect to each pixel circuit based on the voltage measured by the voltage measurement circuit.

According to a fifteenth aspect of the present invention, in the fourteenth aspect of the present invention, the pixel circuit further includes: a write control transistor having a first conduction terminal connected to the data line, a second conduction terminal connected to the control terminal of the drive transistor, and a control terminal connected to a first scanning line in the scanning lines; and a read control transistor having a first conduction terminal connected to the data line, a second conduction terminal connected to a connection point of the drive transistor and the electro-optical element, and a control terminal connected to a second scanning line in the scanning lines, and the voltage measurement circuit is connected to the data line and is configured to measure a voltage at the connection point of the drive transistor and the electro-optical element.

According to a sixteenth aspect of the present invention, there is provided a drive method for an active-matrix type display device including a display unit having a plurality of scanning lines, a plurality of data lines, and a plurality of pixel circuits arranged two-dimensionally, the method including the steps of: driving the scanning lines; and driving the data lines, wherein the pixel circuit includes an electro-optical element, and a drive transistor having a control terminal and connected in series with the electro-optical element, and the drive transistor is configured to operate in a saturation region when a data voltage applied to the control terminal in driving the data lines is in a first range, and operate in a triode region when the data voltage is in a second range.

According to a seventeenth aspect of the present invention, in the sixteenth aspect of the present invention, the drive method further includes: measuring a current or a voltage with respect to the pixel circuit at an outside of the display unit; and correcting a video signal to be used for driving the data line, based on a measured current or a measured voltage, wherein the correcting includes determining in which operation region the drive transistor operates between the saturation region and the triode region with respect to each pixel circuit based on the video signal, and correcting the video signal in accordance with the operation region of the drive transistor.

Effects of the Invention

According to the first or sixteenth aspect of the present invention, the drive transistor operates in the saturation region when the data voltage is in the first range, and operates in the triode region when the data voltage is in the second range. Therefore, it is possible to reduce a power supply voltage supplied to the drive transistor and provide a low power consumption display device.

According to the second or seventeenth aspect of the present invention, the operation region of the drive transistor is determined with respect to each pixel circuit based on the video signal, and the video signal is corrected in accordance with the operation region of the drive transistor. Therefore, it is possible to reduce the power supply voltage supplied to the drive transistor, while correcting in a similar manner to that in a case where the drive transistor operates only in the saturation region. With this, a high image quality and low power consumption display device can be provided.

According to the third aspect of the present invention, it is possible to compensate for variation and fluctuation of characteristics of the drive transistor and the electro-optical element and perform high image quality display, by obtaining the characteristics of the drive transistor and the electro-optical element with respect to each pixel circuit and correcting the video signal using these values.

According to the fourth aspect of the present invention, it is possible to obtain a voltage to be applied to the drive transistor and a voltage to be applied to the electro-optical element, based on the code value included in the video signal, and corrects the former voltage in accordance with the operation region of the drive transistor.

According to the fifth aspect of the present invention, the operation region of the drive transistor can be suitably determined, by determining the operation region of the drive transistor based on a correction result of the voltage to be applied to the electro-optical element.

According to the sixth aspect of the present invention, even when the operation region of the drive transistor is switched, it is possible to prevent a display screen from being unstable due to a variation of the power supply voltage by stabilizing the power supply voltage using the operational amplifier.

According to the seventh aspect of the present invention, power consumption of the display device can be further reduced by reducing the power supply voltage supplied to the drive transistor in accordance with a situation.

According to the eighth aspect of the present invention, it is possible to measure the current flowing through the pixel circuit and correct the video signal based on the measured current.

According to the ninth aspect of the present invention, I-V characteristics (current-voltage characteristics) of the drive transistor and the electro-optical element can be obtained, by measuring the current flowing through the drive transistor or the electro-optical element when the measurement voltage is written and obtaining the threshold voltage and the gain of the drive transistor and the electro-optical element based on the measurement result. It is possible to perform high image quality display by correcting the video signal using the threshold voltage and the gain of the drive transistor and the electro-optical element.

According to the tenth aspect of the present invention, the current flowing through the pixel circuit can be measured using the current measurement circuit connected to the data line.

According to the eleventh aspect of the present invention, the current flowing through the pixel circuit can be measured using the current measurement circuit connected to the monitor line.

According to the twelfth aspect of the present invention, the current flowing through the pixel circuit can be measured using the current measurement circuit connected to the power supply line.

According to the thirteenth aspect of the present invention, it is possible to measure the voltage of the node in the pixel circuit and correct the video signal based on the measured voltage.

According to the fourteenth aspect of the present invention, I-V characteristics (current-voltage characteristics) of the drive transistor and the electro-optical element can be obtained, by measuring the voltage of the terminals of the drive transistor or the electro-optical element when the measurement current flows through the drive transistor or the electro-optical element and obtaining the threshold voltage and the gain of the drive transistor and the electro-optical element based on the measurement result. It is possible to perform high image quality display by correcting the video signal using the threshold voltage and the gain of the drive transistor and the electro-optical element.

According to the fifteenth aspect of the present invention, the voltage of the node in the pixel circuit can be measured using the voltage measurement circuit connected to the data line.

MODES FOR CARRYING OUT THE INVENTION

Figure 1:
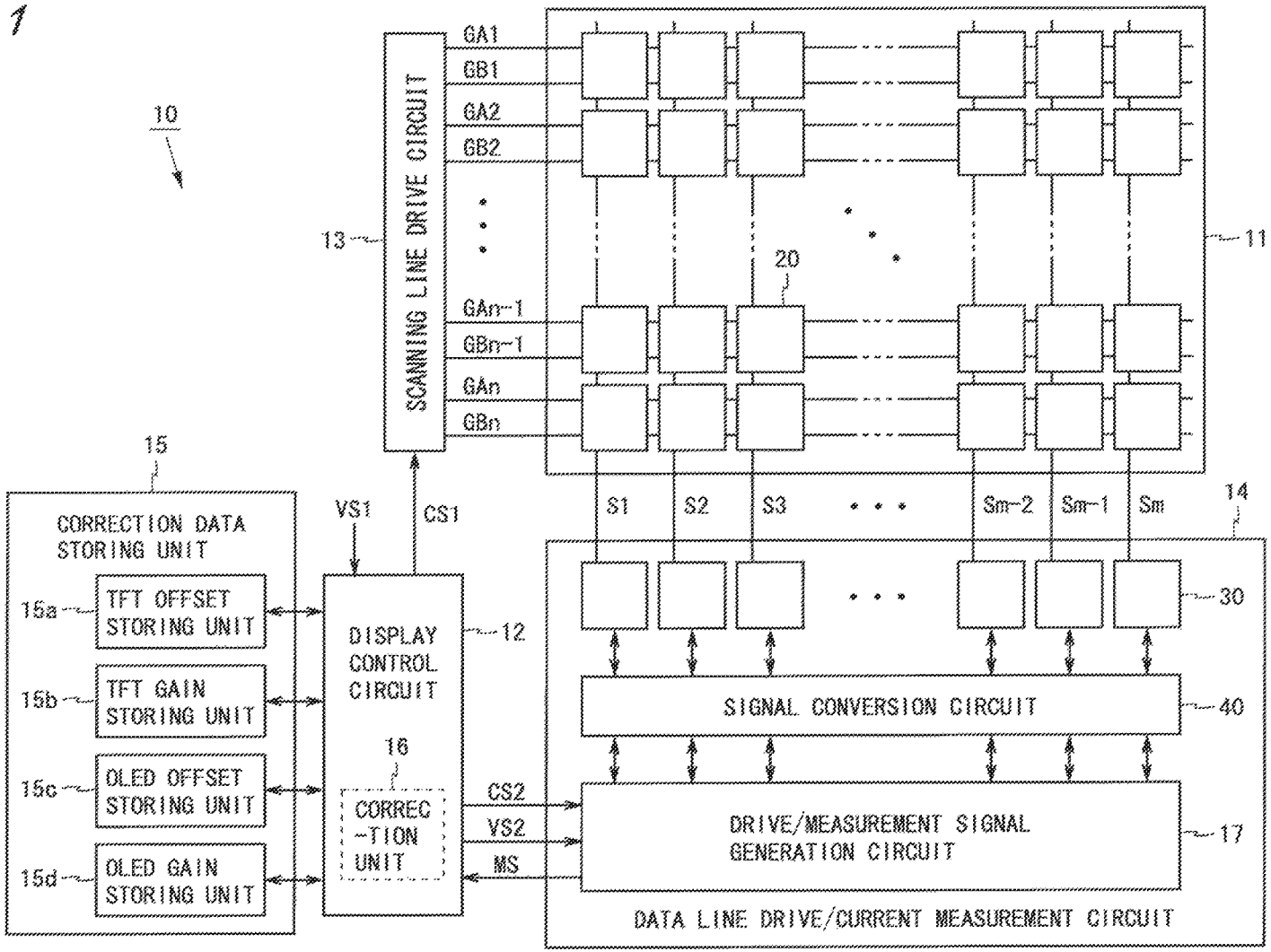
FIG. 1 is a block diagram showing a configuration of a display device according to a first embodiment of the present invention.

In the following, display devices according to embodiments of the present invention will be described referring to the drawings. Each of the display devices according to the embodiments of the present invention is an active-matrix type organic EL display device having a pixel circuit including an organic EL element and a drive transistor. In general, when a threshold voltage of a transistor is Vth, a drain-source voltage of the transistor is Vds, and a gate-source voltage of the transistor is Vgs, a region in which $Vds \geq Vgs - Vth$ is satisfied is referred to as saturation region, and a region in which $Vds < Vgs - Vth$ is satisfied is referred to as triode region (or linear region). In each of the display devices according to the embodiments of the present invention, a drive transistor in a pixel circuit operates in the saturation region when a data voltage is in a first range, and operates in the triode region when the data voltage is in a second range. In the following description, a thin film transistor may be referred to as TFT, and an organic EL element may be referred to as OLED (Organic Light Emitting Diode). Furthermore, it is assumed that m, n, and p are integers not less than 2, i is an integer not less than 1 and not more than n, and j is an integer not less than 1 and not more than m.

First Embodiment

FIG. 1 is a block diagram showing a configuration of a display device according to a first embodiment of the present invention. A display device 10 shown in FIG. 1 includes a display unit 11, a display control circuit 12, a scanning line drive circuit 13, a data line drive/current measurement circuit 14 (a combined circuit of a data line drive circuit and a current measurement circuit), and a correction data storing unit 15. The display control circuit 12 includes a correction unit 16.

The display unit 11 includes 2n scanning lines GA1 to GAn, GB1 to GBn, m data lines S1 to Sm, and (m×n) pixel circuits 20. The scanning lines GA1 to GAn, GB1 to GBn are arranged in parallel to each other. The data lines S1 to Sm are arranged in parallel to each other so as to intersect with the scanning lines GA1 to GAn, GB1 to GBn perpendicularly. The scanning lines GA1 to GAn and the data lines S1 to Sm intersect at (m×n) points. The (m×n) pixel circuits 20 are arranged two-dimensionally corresponding to the intersections of the scanning lines GA1 to GAn and the data lines S1 to Sm. A high-level power supply voltage ELVDD and a low-level power supply voltage ELVSS are supplied to the pixel circuit 20 using a power supply line or a power supply electrode not shown.

A video signal VS1 is input to the display device 10 from the outside. Based on the video signal VS1, the display control circuit 12 outputs a control signal CS1 to the scanning line drive circuit 13, and outputs a control signal CS2 and a video signal VS2 to the data line drive/current measurement circuit 14. The control signal CS1 includes a gate start pulse and a gate clock, for example. The control signal CS2 includes a source start pulse and a source clock, for example. The video signal VS2 is obtained by correcting the video signal VS1 in the correction unit 16 in a later-described manner.

The scanning line drive circuit 13 and the data line drive/current measurement circuit 14 are provided at an outside of the display unit 11. The scanning line drive circuit 13 and the data line drive/current measurement circuit 14 selectively perform a processing for writing a data voltage in accordance with the video signal VS2 to the pixel circuit 20, and a processing for measuring a current flowing through the pixel circuit 20 when a measurement voltage is written to the pixel circuit 20. Hereinafter, the former is referred to as "writing", and the latter is referred to as "measuring current".

The scanning line drive circuit 13 drives the scanning lines GA1 to GAn, GB1 to GBn based on the control signal CS1. When writing, the scanning line drive circuit 13 sequentially selects one scanning line from among the scanning lines GA1 to GAn, and applies a selection voltage (here, a high-level voltage) to the selected scanning line. With this, m pieces of the pixel circuits 20 connected to the selected scanning line are selected collectively.

The data line drive/current measurement circuit 14 includes a drive/measurement signal generation circuit 17 (a generation circuit of a drive signal and a measurement signal), a signal conversion circuit 40, and m output/measurement circuits 30 (a combined circuit of an output circuit and a measurement circuit), and drives the data lines S1 to Sm based on the control signal CS2. When writing, the data line drive/current measurement circuit 14 applies m data voltages in accordance with the video signal VS2 to the data lines S1 to Sm, respectively. With this, the m data voltages are written to the m selected pixel circuits 20, respectively.

Operations of the scanning line drive circuit 13 and the data line drive/current measurement circuit 14 when measuring the current will be described later. The data line drive/current measurement circuit 14 outputs, to the display control circuit 12, a monitor signal MS indicating a result of measuring the current flowing through the pixel circuit 20.

The correction unit 16 obtains the video signal VS2 by obtaining characteristics of a drive transistor and an organic EL element in the pixel circuit 20 based on the monitor signal MS and correcting the video signal VS1 using the obtained characteristics. The correction data storing unit 15 is a working memory of the correction unit 16. The correction data storing unit 15 includes a TFT offset storing unit 15*a*, a TFT gain storing unit 15*b*, an OLED offset storing unit 15*c*, and an OLED gain storing unit 15*d*. The TFT offset storing unit 15*a* stores a threshold voltage of the drive transistor for each pixel circuit 20. The TFT gain storing unit 15*b* stores a gain of the drive transistor for each pixel circuit 20. The OLED offset storing unit 15*c* stores a threshold voltage of the organic EL element for each pixel circuit 20. The OLED gain storing unit 15*d* stores a gain of the organic EL element for each pixel circuit 20.

Figure 2:
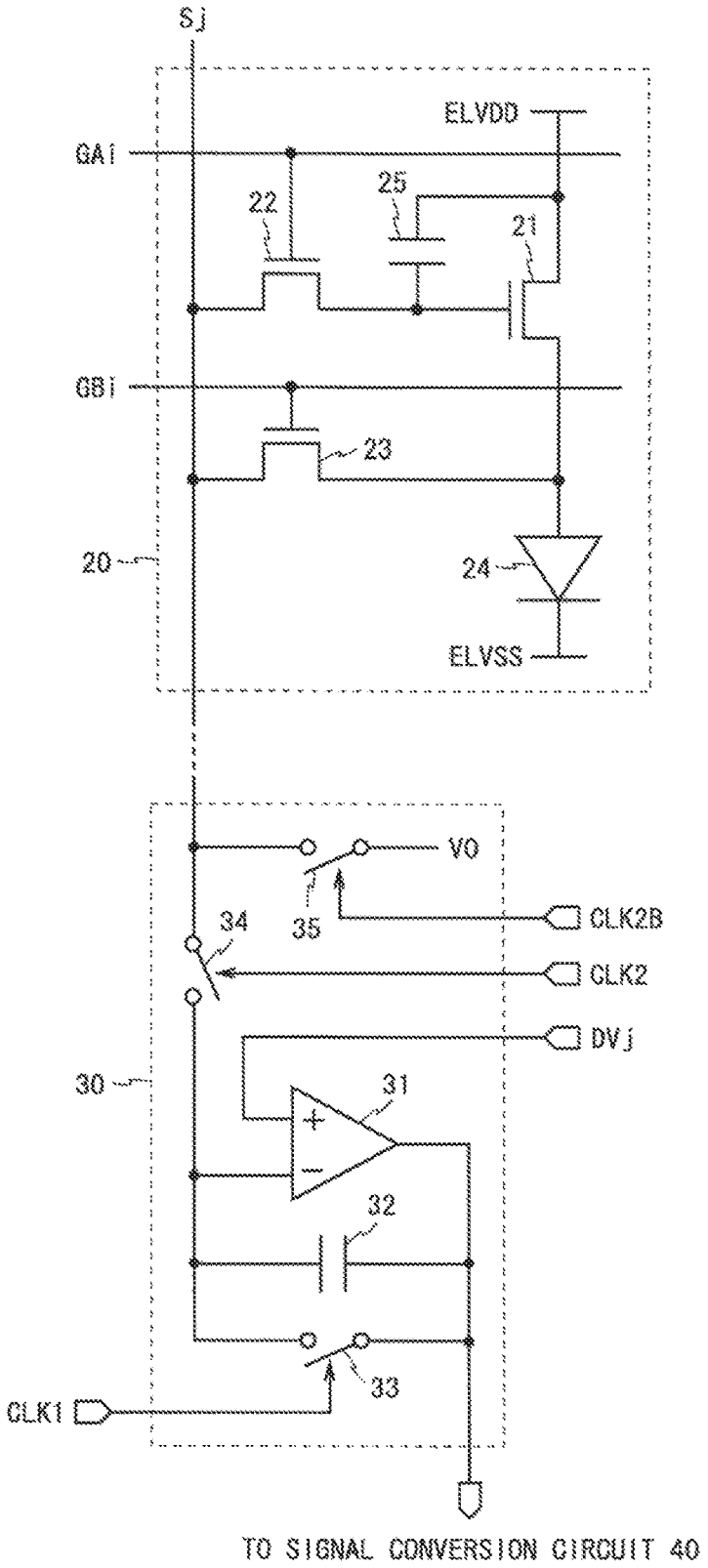
FIG. 2 is a circuit diagram of a pixel circuit and an output/measurement circuit of the display device shown in FIG. 1.

FIG. 2 is a circuit diagram of the pixel circuit 20 and the output/measurement circuit 30. FIG. 2 depicts a pixel circuit 20 in an i-th row and a j-th column and an output/measurement circuit 30 corresponding to a data line Sj. As shown in FIG. 2, the pixel circuit 20 in the i-th row and the j-th column includes transistors 21 to 23, an organic EL element 24, and a capacitor 25, and is connected to scanning lines GAi, GBi and the data line Sj. The transistors 21 to 23 are N-channel type TFTs.

The high-level power supply voltage ELVDD is applied to a drain terminal of the transistor 21. A source terminal of the transistor 21 is connected to an anode terminal of the organic EL element 24. The low-level power supply voltage ELVSS is applied to a cathode terminal of the organic EL element 24. One conduction terminals of the transistors 22, 23 (left-side terminals in FIG. 2) are connected to the data line Sj. The other conduction terminal of the transistor 22 is connected to a gate terminal of the transistor 21, and a gate terminal of the transistor 22 is connected to the scanning line GAi. The other conduction terminal of the transistor 23 is connected to the source terminal of the transistor 21 and the anode terminal of the organic EL element 24, and a gate terminal of the transistor 23 is connected to the scanning line GBi. The capacitor 25 is provided between the gate terminal and the drain terminal of the transistor 21. The transistors 21 to 23 function as a drive transistor, a write control transistor, and a read control transistor, respectively.

The output/measurement circuit 30 corresponding to the data line Sj includes an operational amplifier 31, a capacitor 32, and switches 33 to 35, and is connected to the data line Sj. One end (upper end in FIG. 2) of the switch 34 and one end (left end in FIG. 2) of the switch 35 are connected to the data line Sj. A predetermined voltage V0 is applied to the other end of the switch 35. An output signal DVj of a D/A converter (not shown) corresponding to the data line Sj is applied to a non-inverting input terminal of the operational amplifier 31. An inverting input terminal of the operational amplifier 31 is connected to the other end of the switch 34. The capacitor 32 is provided between the inverting input terminal and an output terminal of the operational amplifier 31. The switch 33 is provided in parallel with the capacitor 32 between the inverting input terminal and the output terminal of the operational amplifier 31. The switches 33 to 35 turn on when switch control signals CLK1, CLK2, CLK2B are in a high level, respectively. The switch control signal CLK2B is an inverted signal of the switch control signal CLK2.

Figure 3:
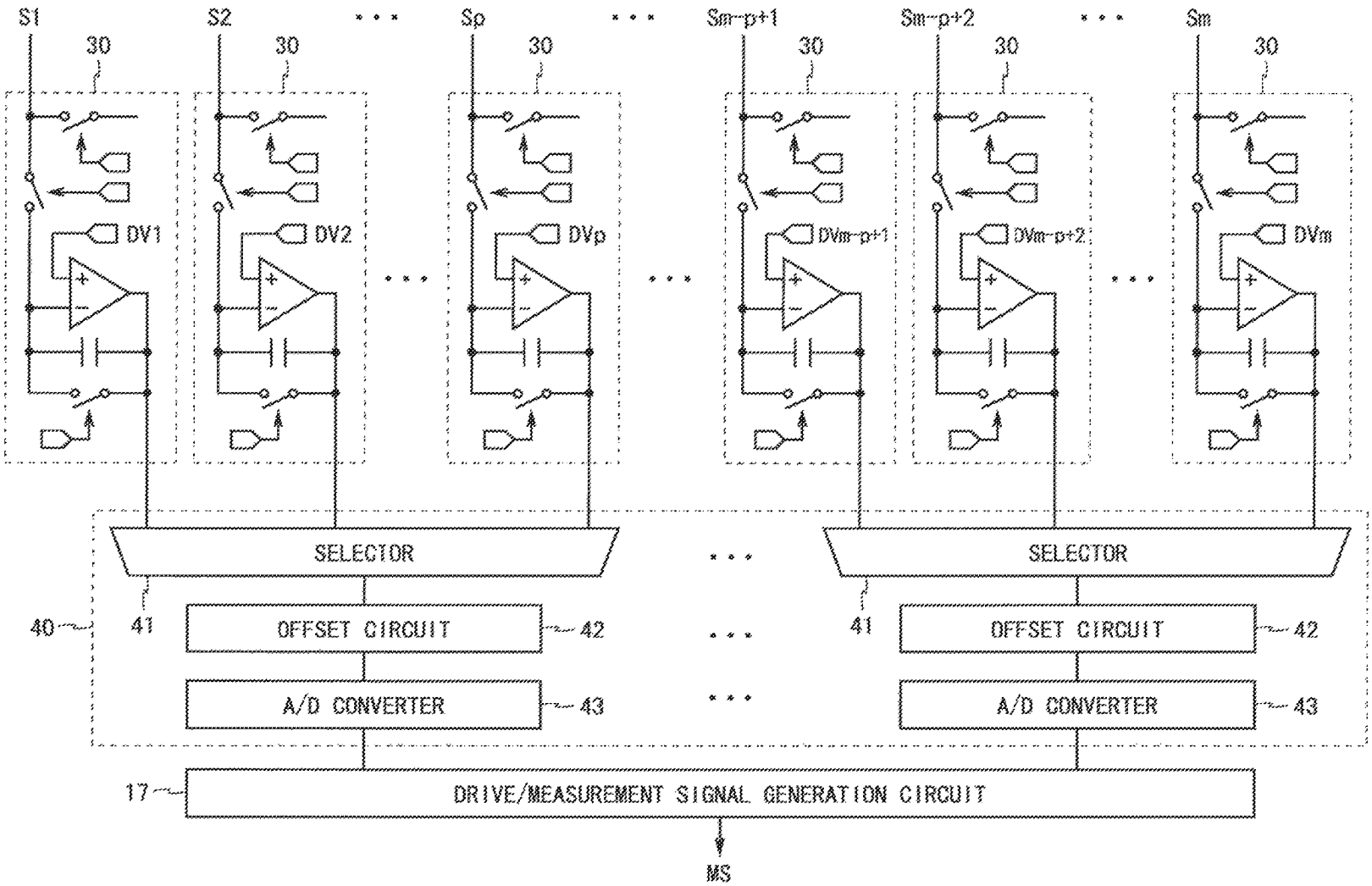
FIG. 3 is a block diagram showing a part of a signal conversion circuit of the display device shown in FIG. 1 in detail.

FIG. 3 is a block diagram showing a part of the signal conversion circuit 40 in detail. As shown in FIG. 3, the m output/measurement circuits 30 are provided corresponding to the m data lines S1 to Sm. The data lines S1 to Sm are classified into (m/p) groups, each group including p data lines. The signal conversion circuit 40 includes (m/p) selectors 41, (m/p) offset circuits 42, and (m/p) A/D converters 43. The selector 41, the offset circuit 42, and the A/D converter 43 are corresponded to one group of the data lines. In a preceding stage of each selector 41, p pieces of the output/measurement circuits 30 are provided. In a next stage of the (m/p) A/D converters 43, the drive/measurement signal generation circuit 17 is provided.

The selector 41 is connected to output terminals of the p operational amplifiers 31. The selector 41 selects one analog signal from among output signals of the p operational amplifiers 31. The offset circuit 42 adds a predetermined offset to the analog signal selected by the selector 41. The A/D converter 43 converts the analog signal output from the offset circuit 42 to a digital value. The drive/measurement signal generation circuit 17 temporarily stores the digital values obtained by the (m/p) A/D converters 43. Each selector 41 sequentially selects output signals of the p operational amplifiers 31. When the selector 41 finishes selection p times, the drive/measurement signal generation circuit 17 stores m digital values in all. The drive/measurement signal generation circuit 17 outputs the monitor signal MS including the m digital values to the display control circuit 12.

In order to correct the video signal VS1 to obtain the video signal VS2, the data line drive/current measurement circuit 14 measures four kinds of currents with respect to each pixel circuit 20. More specifically, in order to obtain characteristics of the transistor 21 in each pixel circuit 20, the data line drive/current measurement circuit 14 measures a current Im1 flowing out from the pixel circuit 20 when a first measurement voltage Vm1 is written to the pixel circuit 20, and a current Im2 flowing out from the pixel circuit 20 when a second measurement voltage Vm2 (>Vm1) is written to the pixel circuit 20. Furthermore, in order to obtain characteristics of the organic EL element 24 in each pixel circuit 20, the data line drive/current measurement circuit 14 measures a current Im3 flowing into the pixel circuit 20 when a third measurement voltage Vm3 is written to the pixel circuit 20, and a current Im4 flowing into the pixel circuit 20 when a fourth measurement voltage Vm4 (>Vm3) is written to the pixel circuit 20. Hereinafter, measuring the currents Im1, Im2 is referred to as "detecting characteristics of the drive transistor", and measuring the currents Im3, Im4 is referred to as "detecting characteristics of the organic EL element".

The scanning line drive circuit 13 and the data line drive/current measurement circuit 14 perform a processing for writing to the pixel circuits 20 in one row and a processing for measuring one of four kinds of the currents Im1 to Im4 with respect to the pixel circuits 20 in one row. For example, in four consecutive frame periods, the scanning line drive circuit 13 and the data line drive/current measurement circuit 14 may measure the currents Im1 to Im4 with respect to the pixel circuits 20 in the i-th row in an i-th line period in first to fourth frame periods, and may perform a processing for writing to the pixel circuits 20 in one row in other line periods.

Figure 4:
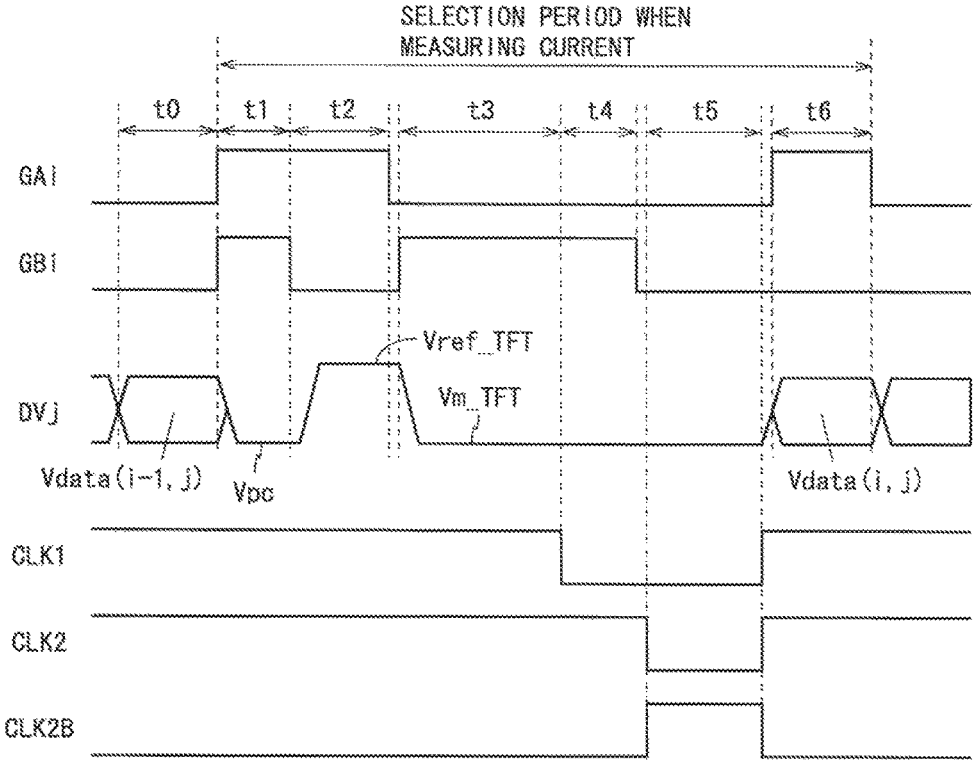
FIG. 4 is a timing chart when detecting characteristics of a drive transistor in the display device shown in FIG. 1.
Figure 5:
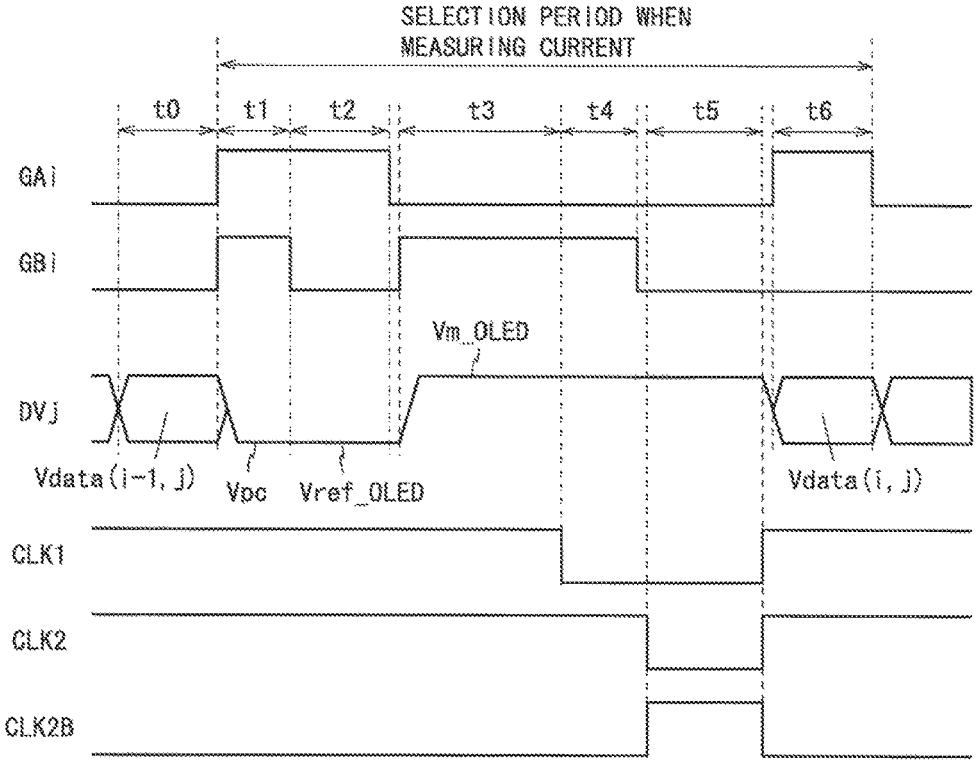
FIG. 5 is a timing chart when detecting characteristics of an organic EL element in the display device shown in FIG. 1.

FIG. 4 is a timing chart when detecting the characteristics of the drive transistor. FIG. 5 is a timing chart when detecting the characteristics of the organic EL element. In FIGS. 4 and 5, a period t0 is included in a selection period when writing to the pixel circuits 20 in an (i−1)-th row, and periods t1 to t6 are included in a selection period when measuring current with respect to the pixel circuits 20 in the i-th row. The selection period when measuring the current includes a reset period t1, a reference voltage write period t2, a measurement voltage write period t3, a current measurement period t4, an A/D conversion period t5, and a data voltage write period t6. Hereinafter, signals on the scanning lines GAi, GBi are referred to as scanning signals GAi, GBi, and a voltage of an output signal of the D/A converter corresponding to the data line Sj is referred to as DVj.

Before the period t1, the scanning signals GAi, GBi and the switch control signal CLK2B are in a low level, and the switch control signals CLK1, CLK2 are in a high level. In the period t0, the scanning signal GAi−1 (not shown) becomes the high level, the scanning signal GBi−1 (not shown) becomes the low level, and the voltage DVj becomes a data voltage Vdata(i−1,j) to be written to the pixel circuit 20 in the (i−1)-th row and the j-th column.

In the period t1, the scanning signals GAi, GBi become the high level, and the voltage DVj becomes a precharge voltage Vpc. The precharge voltage Vpc is determined so that the transistor 21 turns off. Especially, it is desirable that the precharge voltage Vpc be determined as high as possible in a range where both a drive transistor (transistor 21) and the organic EL element 24 turn off (the reason will be described later). In the period t1, in the pixel circuits 20 in the i-th row, the transistors 22, 23 turn on, and the precharge voltage Vpc is applied to the gate terminal and the source terminal of the transistor 21 and the anode terminal of the organic EL element 24. With this, the transistor 21 and the organic EL element 24 in the pixel circuits 20 in the i-th row are initialized.

For example, when the transistor 21 is formed using a semiconductor oxide such as an InGaZnO (Indium Gallium Zinc Oxide), the transistor 21 may have hysteresis characteristics. If the transistor 21 is used without an initialization in this case, a current measurement result may vary depending on a previous display status. By providing the reset period t1 at the start of the selection period when measuring current and initializing the transistor 21 in the reset period t1, variation of the current measurement result due to the hysteresis characteristics can be prevented. Note that since the organic EL element 24 does not have the hysteresis characteristics, it is not necessary to provide the reset period t1 when detecting the characteristics of the organic EL element. Furthermore, when the current is measured not when displaying but in a non-display state just after power on or during display off, the reset period may be omitted.

In the period t2, the scanning signal GAi becomes the high level, the scanning signal GBi becomes the low level, and the voltage DVj becomes a reference voltage (Vref_TFT when detecting the characteristics of the drive transistor, Vref_OLED when detecting characteristics of the organic EL element). In the period t2, in the pixel circuit 20 in the i-th row and the j-th column, the transistor 22 turns on, the transistor 23 turns off, and the reference voltage Vref_TFT or Vref_OLED is applied to the gate terminal of the transistor 21. The reference voltage Vref_TFT is determined to be a high voltage so that the transistor 21 turns on in the periods t3, t4. The reference voltage Vref_OLED is determined to be a low voltage so that the transistor 21 turns off in the periods t3, t4.

In the period t3, the scanning signal GAi becomes the low level, the scanning signal GBi becomes the high level, and the voltage DVj becomes one of the first to fourth measurement voltages Vm1 to Vm4. Vm_TFT shown in FIG. 4 represents one of the first and second measurement voltages Vm1, Vm2, and Vm_OLED shown in FIG. 5 represents one of the third and fourth measurement voltages Vm3, Vm4. In the period t3, in the pixel circuit 20 in the i-th row and the j-th column, the transistor 22 turns off, the transistor 23 turns on, and one of the first to fourth measurement voltages Vm1 to Vm4 is applied to the anode terminal of the organic EL element 24. When detecting the characteristics of the drive transistor, the transistor 21 turns on, and a current flows from the power supply line or the power supply electrode having the high-level power supply voltage ELVDD via the transistors 21, 23 to the data line Sj. When detecting the characteristics of the organic EL element, the transistor 21 turns off, and a current flows from the data line Sj via the transistor 23 and the organic EL element 24 to the power supply line or the power supply electrode having the low-level power supply voltage ELVSS. When some time passes after the start of the period t3, the data line Sj is charged to a predetermined voltage level, and a current flowing out from the pixel circuit 20 to the data line Sj (or a current flowing from the data line Sj into the pixel circuit 20) becomes constant.

Note that in a case where a source potential of the transistor 21 in the period t2 is low when detecting the characteristics of the drive transistor, a gate-source voltage of the transistor 21 becomes large at the start of the period t3, a large current flows through the transistor 21, and the organic EL element 24 emits light. In order to prevent emitting light at this time, as described above, the precharge voltage Vpc applied in the period t1 is determined to be high in a range where both the drive transistor and the organic EL element 24 turn off.

In the period t4, the scanning signals GAi, GBi and the voltage DVj keep the same level as in the period t3, and the switch control signal CLK1 becomes the low level. In the period t4, the switch 33 turns off, and the output terminal and the inverting input terminal of the operational amplifier 31 are connected via the capacitor 32. At this time, the operational amplifier 31 and the capacitor 32 function as an integration amplifier. An output voltage of the operational amplifier 31 at the end of the period t4 is determined by an amount of the current flowing through the pixel circuit 20 in the i-th row and the j-th column and the data line Sj, a capacitance of the capacitor 32, a length of the period t4, and the like.

In the period t5, the scanning signals GAi, GBi and the switch control signals CLK1, CLK2 become the low level, the switch control signal CLK2B becomes the high level, and the voltage DVj keeps the same level as in the periods t3, t4. In the period t5, in the pixel circuit 20 in the i-th row and the j-th column, the transistors 22, 23 turn off. Since the switch 34 turns off and the switch 35 turns on, the data line Sj is electrically disconnected from the non-inverting input terminal of the operational amplifier 31, and the voltage V0 is applied to the data line Sj. Since the non-inverting input terminal of the operational amplifier 31 is electrically disconnected from the data line Sj, an output voltage of the operational amplifier 31 becomes constant. In the period t5, the offset circuit 42 corresponding to a group including the data line Sj adds the offset to the output voltage of the operational amplifier 31, and the A/D converter 43 corresponding to the group converts an analog signal after adding the offset to a digital value (refer to FIG. 3).

In the period t6, the scanning signal GAi becomes the high level, the scanning signal GBi becomes the low level, and the voltage DVj becomes a data voltage Vdata(i,j) to be written to the pixel circuit 20 in the i-th row and the j-th column. In the period t6, in the pixel circuit 20 in the i-th row and the j-th column, the transistor 22 turns on, and the data voltage Vdata(i,j) is applied to the gate terminal of the transistor 21. When the scanning signal GAi changes to the low level at the end of the period t6, the transistor 22 in the pixel circuit 20 in the i-th row and the j-th column turns off. After that, in the pixel circuit 20 in the i-th row and the j-th column, the gate voltage of the transistor 21 is kept at Vdata(i,j) by the action of the capacitor 25.

The correction unit 16 performs a processing for obtaining the characteristics of the transistor 21 and the organic EL element 24 based on the measured four kinds of the currents Im1 to Im4, and corrects the video signal VS1 based on the obtained two kinds of characteristics. More specifically, the correction unit 16 obtains the threshold voltage and the gain as the characteristics of the transistor 21 based on the two kinds of currents Im1, Im2. The threshold voltage of the transistor 21 is written to the TFT offset storing unit 15*a*, and the gain of the transistor 21 is written to the TFT gain storing unit 15*b*. Furthermore, the correction unit 16 obtains the threshold voltage and the gain as the characteristics of the organic EL element 24 based on the two kinds of currents Im3, Im4. The threshold voltage of the organic EL element 24 is written to the OLED offset storing unit 15*c*, and the gain of the organic EL element 24 is written to the OLED gain storing unit 15*d*. The correction unit 16 reads the threshold voltage and the gain from the correction data storing unit 15, and corrects the video signal VS1 using these values.

First, a processing for obtaining the threshold voltage and the gain of the transistor 21 will be described. When the transistor 21 operates in the saturation region, the following equation (1) is approximately satisfied among a gate-source voltage Vgs, a drain current Id, a threshold voltage $Vth_{TFT}$, and a gain $\beta_{TFT}$ of the transistor 21.

$$Id=(\beta_{TFT}/2)\times(Vgs-Vth_{TFT})^2 \quad (1)$$

A gate-source voltage of the transistor 21 when a first measurement voltage Vm1 is written to the pixel circuit 20 is denoted by Vgsm1, a drain current of the transistor 21 at that time is denoted by Im1, the gate-source voltage of the transistor 21 when a second measurement voltage Vm2 is written to the pixel circuit 20 is denoted by Vgsm2, and the drain current of the transistor 21 at that time is denoted by Im2. From the equation (1), the following equation (2a) is satisfied between the voltage Vgsm1 and the current Im1, and the following equation (2b) is satisfied between the voltage Vgsm2 and the current Im2.

$$Im1=(\beta_{TFT}/2)\times(Vgsm1-Vth_{TFT})^2 \quad (2a)$$

$$Im2=(\beta_{TFT}/2)\times(Vgsm2-Vth_{TFT}) \quad (2b)$$

The following equations (3a), (3*b*) are derived by solving the equations (2a), (2b) for $Vth_{TFT}$ and $\beta_{TFT}$.

$$Vth_{TFT}=\frac{Vgsm1\sqrt{Im2}-Vgsm2\sqrt{Im1}}{\sqrt{Im2}-\sqrt{Im1}} \quad (3a)$$

$$\beta_{TFT}=\frac{2\left(\sqrt{Im2}-\sqrt{Im1}\right)^2}{(Vgsm2-Vgsm1)^2} \quad (3b)$$

By measuring the currents Im1, Im2 and solving the equations (2a), (2b), it is possible to obtain the threshold voltage $Vth_{TFT}$ and the gain $\beta_{TFT}$ of the transistor 21 and obtain I-V characteristics of the transistor 21. The threshold voltage $Vth_{TFT}$ is written to the TFT offset storing unit 15*a*, and the gain $\beta_{TFT}$ is written to the TFT gain storing unit 15*b*.

Next, a processing for obtaining the threshold voltage and the gain of the organic EL element 24 will be described. The following equation (4) is approximately satisfied among an anode-cathode voltage Vo, a current Io, a threshold voltage $Vth_{OLED}$, and a gain $\beta_{OLED}$ Of the organic EL element 24. In equation (4), K is a constant not less than 2 and not more than 3.

$$Io=\beta_{OLED}(Vo-Vth_{OLED})^K \quad (4)$$

An anode-cathode voltage of the organic EL element 24 when a third measurement voltage Vm3 is written to the pixel circuit 20 is denoted by Vom3, a current of the organic EL element 24 at that time is denoted by Im3, the anode-cathode voltage of the organic EL element 24 when a fourth measurement voltage Vm4 is written to the pixel circuit 20 is denoted by Vom4, and the current of the organic EL element 24 at that time is denoted by Im4. From the equation (4), the following equation (5a) is satisfied between the voltage Vom3 and the current Im3, and the following equation (5b) is satisfied between the voltage Vom4 and the current Im4.

$$Im3=\beta_{OLED}(Vom3-Vth_{OLED})^K \quad (5a)$$

$$Im4=\beta_{OLED}(Vom4-Vth_{OLED})^K \quad (5b)$$

The following equations (6a), (6b) are derived by solving the equations (5a), (5b) for $Vth_{OLED}$ and $\beta_{OLED}$.

$$Vth_{OLED}=\frac{Vom3\sqrt[K]{Im4}-Vom4\sqrt[K]{Im3}}{\sqrt[K]{Im4}-\sqrt[K]{Im3}} \quad (6a)$$

$$\beta_{OLED}=\frac{\left(\sqrt[K]{Im4}-\sqrt[K]{Im3}\right)^K}{(Vom4-Vom3)^K} \quad (6b)$$

By measuring the currents Im3, Im4 and solving the equations (5a), (5b), it is possible to obtain the threshold voltage $Vth_{OLED}$ and the gain $\beta_{OLED}$ of the organic EL element 24 and obtain I-V characteristics of the organic EL element 24. The threshold voltage $Vth_{OLED}$ is written to the OLED offset storing unit 15*c*, and the gain $\beta_{OLED}$ is written to the OLED gain storing unit 15*d*.

Figure 6:
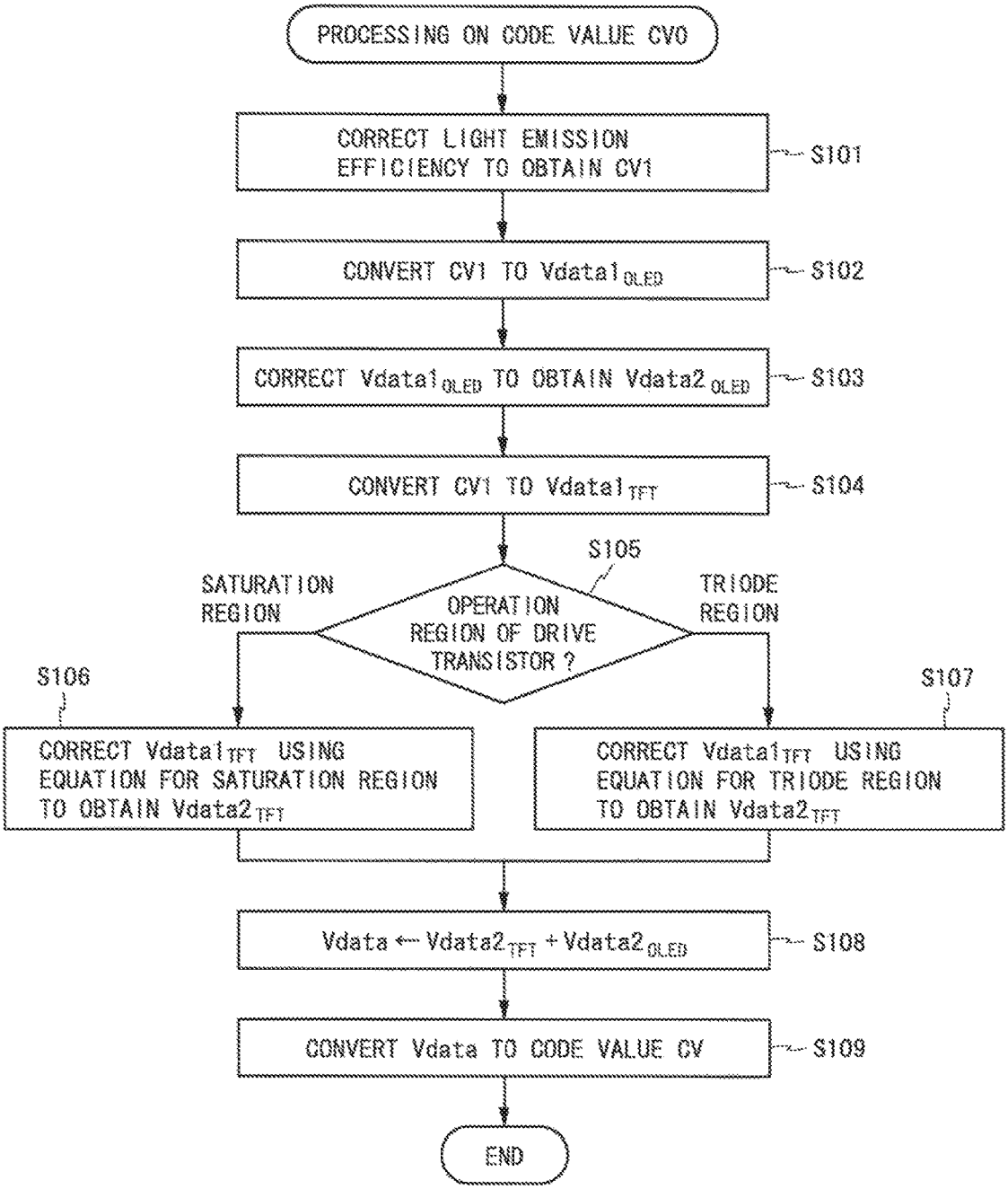
FIG. 6 is a flowchart of a correction processing in the display device shown in FIG. 1.

FIG. 6 is a flowchart of a correction processing on the video signal VS1. The correction unit 16 corrects a code value CV0 included in the video signal VS1 in accordance with the operation region of the transistor 21, using the threshold voltage $Vth_{TFT}$ of the transistor 21, the gain $\beta_{TFT}$ of the transistor 21, the threshold voltage $Vth_{OLED}$ of the organic EL element 24, and the gain $\beta_{OLED}$ of the organic EL element 24. The threshold voltages $Vth_{TFT}$, $Vth_{OLED}$ and the gains $\beta_{TFT}$, $\beta_{OLED}$ used in the following processing are read from the correction data storing unit 15.

First, the correction unit 16 performs a processing for correcting a light emission efficiency of the organic EL element 24 (step S101). Specifically, the correction unit 16 obtains a corrected code value CV1 by performing a calculation shown in the following equation (7).

$$CV1=CV0\times\gamma \quad (7)$$

In the equation (7), γ represents a light emission efficiency correction coefficient determined with respect to each pixel circuit 20. The light emission efficiency correction coefficient γ has a larger value, as the light emission efficiency of the organic EL element 24 in a pixel degrades more. Note that γ may be obtained by a calculation.

Next, the correction unit 16 converts the corrected code value CV1 to a voltage value $Vdata1_{OLED}$ representing the anode-cathode voltage of the organic EL element 24 (step S102). Conversion in step S102 is performed, for example, by a method of referring to a table prepared in advance, or by a method of calculating using a calculation unit.

Next, the correction unit 16 obtains a corrected voltage value $Vdata2_{OLED}$ by performing a calculation shown in the following equation (8) on the voltage value $Vdata1_{OLED}$ (step S103).

$$Vdata2_{OLED}=Vdata1_{OLED}\times B_{OLED}+Vth_{OLED} \quad (8)$$

When an average value of an initial value of the gain of the organic EL element 24 is denoted by $\beta 0_{OLED}$, $B_{OLED}$ included in the equation (8) is given by the following equation (9).

$$B_{OLED}=(\beta 0_{OLED}/\beta_{OLED})^{1/K} \quad (9)$$

Next, the correction unit 16 converts the corrected code value CV1 to a voltage value $Vdata1_{TFT}$ representing the gate-source voltage of the transistor 21 (step S104). The conversion in step S104 is performed in a manner similar to that in step S102.

Next, the correction unit 16 determines, based on the voltage values $Vdata2_{OLED}$, $Vdata1_{TFT}$, in which operation region the transistor 21 operates between the saturation region and the triode region (step S105). More specifically, the correction unit 16 selects the triode region when the following equation (10) is satisfied, and selects the saturation region otherwise.

$$Vds<Vdata1_{TFT}\times B_{TFT} \quad (10)$$

Here, when an average of the gain of the transistor 21 is denoted as $\beta 0_{TFT}$, $B_{TFT}$ included in the equation (10) is given by the following equation (11). Vds included in the equation (10) is given by the following equation (12).

$$B_{TFT}=\sqrt{(\beta 0_{TFT}/\beta_{TFT})} \quad (11)$$

$$Vds=ELVDD-ELVSS-Vdata2_{OLED} \quad (12)$$

The correction unit 16 goes to step S106 when the saturation region is selected, and goes to step S107 when the triode region is selected.

In step S106, the correction unit 16 corrects the voltage value $Vdata1_{TFT}$ using a correction equation for the saturation region. More specifically, the correction unit 16 obtains a corrected voltage value $Vdata2_{TFT}$ by performing a calculation shown in the following equation (13) on the voltage value $Vdata1_{TFT}$.

$$Vdata2_{TFT}=Vdata1_{TFT}\times B_{TFT}+Vth_{TFT} \quad (13)$$

In step S107, the correction unit 16 corrects the voltage value $Vdata1_{TFT}$ using a correction equation for the triode region. More specifically, the correction unit 16 obtains the corrected voltage value $Vdata2_{TFT}$ by performing a calculation shown in the following equation (14) on the voltage value $Vdata1_{TFT}$.

$$Vdata2_{TFT}=Vdata1_{TFT}^2\times B_{TFT}^2/2Vds+Vth_{TFT}+Vds/2 \quad (14)$$

After executing step S106 or S107, the correction unit 16 goes to step S108. In step S108, the correction unit 16 adds the corrected voltage value $Vdata2_{OLED}$ obtained in step S103 to the corrected voltage value $Vdata2_{TFT}$ obtained in step S106 or S107 in accordance with the following equation (15). With this, the voltage value Vdata representing a voltage to be applied to the gate terminal of the transistor 21 is obtained.

$$Vdata=Vdata2_{TFT}+Vdata2_{OLED} \quad (15)$$

Finally, the correction unit 16 converts the voltage value Vdata to an output code value CV (step S109). Conversion in step S109 is performed in a manner similar to those in steps S102, S104.

As described, the correction unit 16 obtains the voltage $Vdata1_{TFT}$ to be applied to the transistor 21 and the voltage $Vdata1_{OLED}$ to be applied to the organic EL element 24, based on the code value CV0 included in the video signal VS1, corrects the voltage $Vdata1_{OLED}$ using the threshold voltage $Vth_{OLED}$ and the gain $\beta_{OLED}$ of the organic EL element 24, corrects the voltage $Vdata1_{TFT}$ in accordance with the operation region of the transistor 21 using the threshold voltage $Vth_{TFT}$ and the gain $\beta_{TFT}$ of the transistor 21, and obtains the code value CV corresponding to a sum of the corrected voltages $Vdata2_{TFT}$ and $Vdata2_{OLED}$. Furthermore, the correction unit 16 determines the operation region of the drive transistor 21 based on the voltage $Vdata1_{TFT}$ and the corrected voltage $Vdata2_{OLED}$, after correcting the voltage $Vdata1_{OLED}$.

Figure 7:
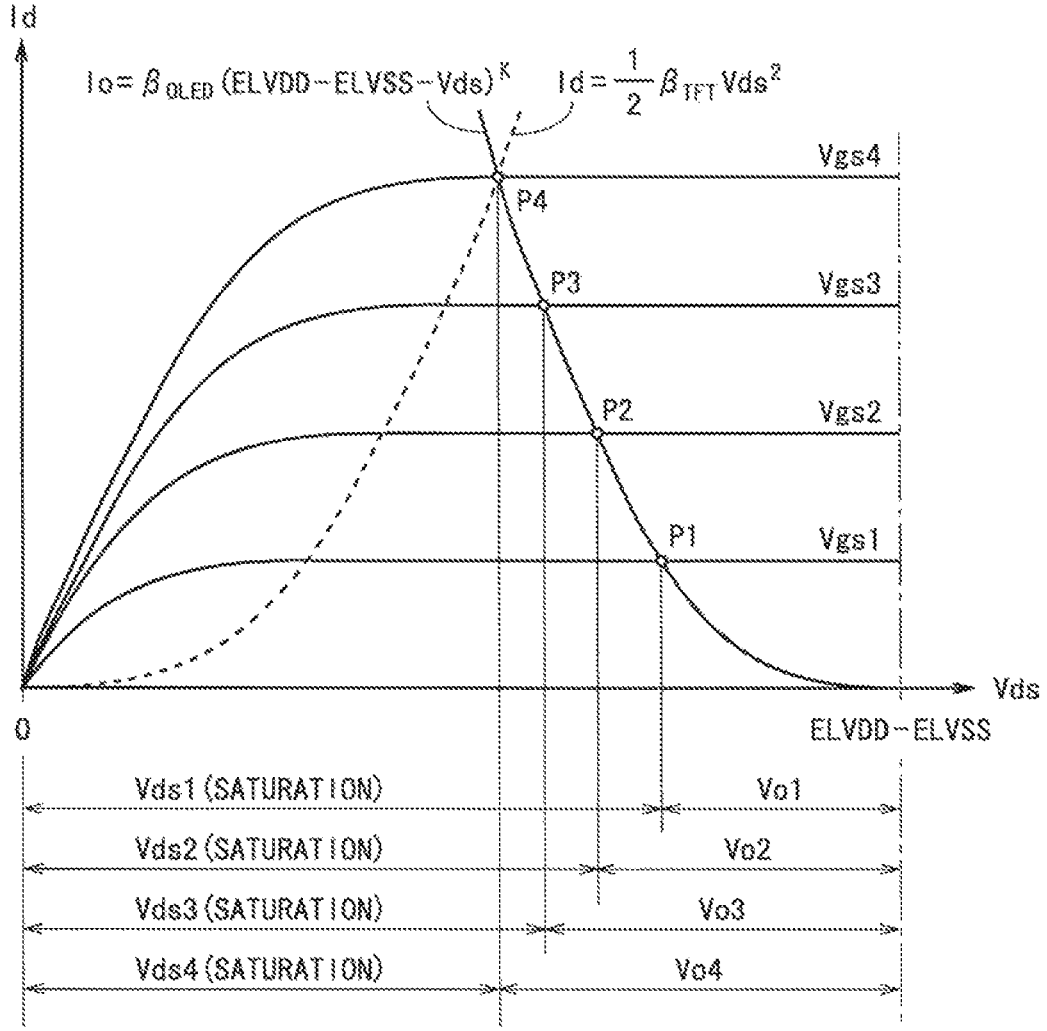
FIG. 7 is an I-V characteristics diagram of a drive transistor in a conventional display device.
Figure 8:
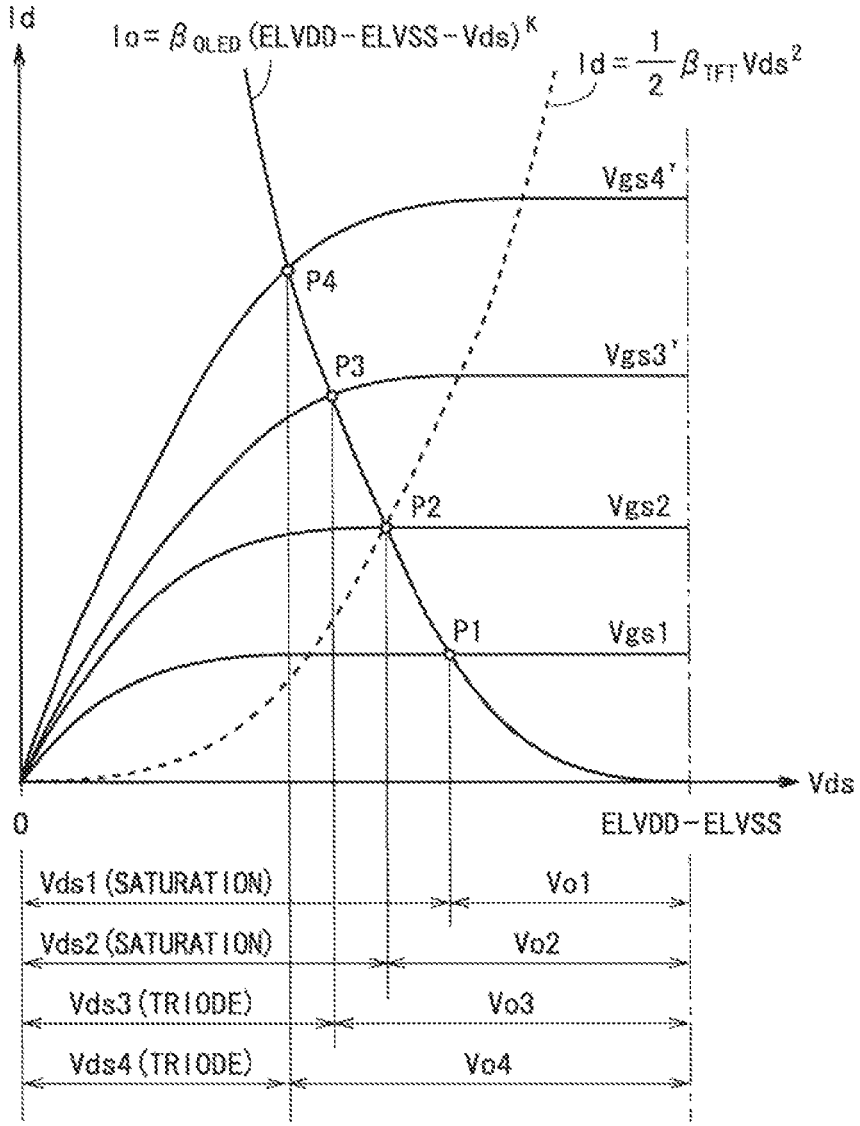
FIG. 8 is an I-V characteristics diagram of the drive transistor in the display device shown in FIG. 1.

Effects of the display device 10 according to the present embodiment will be described below. Here, a display device which has the same configuration as that of the display device 10 and in which the drive transistor operates only in the saturation region will be considered as a comparative example. FIG. 7 is an I-V characteristics diagram of a drive transistor in the display device according to the comparative example. FIG. 8 is an I-V characteristics diagram of the drive transistor (transistor 21) in the display device 10. In FIGS. 7 and 8, a horizontal axis represents a drain-source voltage Vds of the drive transistor, and a vertical axis represents a drain current Id of the drive transistor. P1 to P4 represent operational points of the drive transistor corresponding to first to fourth gradations, respectively.

Vgs1 to Vgs4 shown in FIG. 7 respectively represent gate-source voltages of the drive transistor when one of data voltages corresponding to the first to fourth gradations is applied to the gate terminal of the drive transistor in the display device according to the comparative example. When the gate-source voltage of the drive transistor is one of Vgs1 to Vgs4, an anode-cathode voltage of the organic EL element becomes corresponding one of Vo1 to Vo4, and a drain-source voltage of the drive transistor becomes corresponding one of Vds1 to Vds4. Since all of the voltages Vds1 to Vds4 are not lower than an overdrive voltage, the drive transistor operates in the saturation region when displaying the first to fourth gradations.

As shown in FIG. 8, a power supply voltage (ELVDD−ELVSS) is set smaller in the display device 10 than in the display device according to the comparative example. Vgs1, Vgs2, Vgs3', Vgs4' shown in FIG. 8 respectively represent the gate-source voltage of the drive transistor when one of the data voltage corresponding to the first to fourth gradations is applied to the gate terminal of the drive transistor in the display device 10. When the gate-source voltage of the drive transistor is one of Vgs1, Vgs2, Vgs3', Vgs4', the anode-cathode voltage of the organic EL element becomes corresponding one of Vo1 to Vo4, and the drain-source voltage of the drive transistor becomes corresponding one of Vds1 to Vds4. Whereas the voltages Vds1, Vds2 are not lower than the overdrive voltage, the voltages Vds3, Vds4 are lower than the overdrive voltage. The drive transistor operates in the saturation region when displaying the first or second gradation, and operates in the triode region when displaying the third or fourth gradation.

In the display device 10 according to the present embodiment, the power supply voltage (ELVDD−ELVSS) is smaller than that in the display device according to the comparative example. Furthermore, the correction unit 16 determines, based on the video signal VS1, in which operation region the drive transistor operates between the saturation region and the triode region, and corrects the video signal VS1 in accordance with the operation region of the drive transistor. Therefore, according to the display device 10, power consumption of the drive transistor can be reduced, while performing high image quality display as with the display device according to the comparative example. Furthermore, since a heat generation amount of the drive transistor can be reduced, countermeasure parts against heat (heat sink, and the like) can be simplified. Note that a gradation range in which the drive transistor operates in the triode region is determined considering the characteristics of the drive transistor, and the like.

In the display device 10, the gate-source voltage of the drive transistor when displaying the third or fourth gradation needs to be higher than that in the display device according to the comparative example (Vgs3'>Vgs3, Vgs4'>Vgs4 should be satisfied). When the gate-source voltage Vgs of the drive transistor is controlled to be large, power consumption of the data line drive/current measurement circuit 14 increases. However, in the display device 10, power consumption of the pixel circuit 20 during light emission is larger than the power consumption of the data line drive/current measurement circuit 14. Furthermore, the power consumption of the pixel circuit 20 during light emission is smaller, as the power supply voltage (ELVDD−ELVSS) is smaller. Therefore, it is possible to reduce power consumption of the pixel circuit 20 during light emission more than increase amount of power consumption of the data line drive/current measurement circuit 14, and reduce power consumption of the display device 10.

In general, power consumption of a data line drive circuit increases in population to a square of an amplitude of a voltage applied to a data line. In the display device 10, when the drive transistor operates in the triode region, the gate-source voltage of the drive transistor is larger than that in a conventional one. Thus, power consumption of the data line drive/current measurement circuit 14 is larger than that in the conventional one. Furthermore, the sum of the voltage to be applied to the drive transistor and the voltage to be applied to the organic EL element is used as the data voltage in the display device 10. Thus, a gradation step in the data line drive/current measurement circuit 14 is larger than that in a case where only the voltage to be applied to the drive transistor is used as the data voltage. When the gradation step is small, gradation inversion may occur due to a resolution limitation of the drive circuit.

Taking these points into consideration, in the display device 10, it is desirable that a W/L ratio of the drive transistor be designed large to increase the gain of the drive transistor and reduce the voltage to be applied to the drive transistor. For example, it is desirable a size of the drive transistor be determined so that the gain $\beta_{TFT}$ of the drive transistor is larger than the gain $\beta_{OLED}$ of the organic EL element 24. With this, it is possible to prevent gradation inversion due to the resolution limitation of the drive circuit and suppress increase of the power consumption of the data line drive/current measurement circuit 14.

As described above, the display device 10 according to the present embodiment has the display unit 11 including a plurality of the scanning lines GA1 to GAn, GB1 to GBn, a plurality of the data lines S1 to Sm, and a plurality of the pixel circuits 20 arranged two-dimensionally, the scanning line drive circuit 13 for driving the scanning lines GA1 to GAn, GB1 to GBn, a data line drive circuit (part of the data line drive/current measurement circuit 14) for driving the data lines S1 to Sm. The pixel circuit 20 includes an electro-optical element (organic EL element 24), and a drive transistor (transistor 21) having a control terminal (gate terminal) and connected in series with the electro-optical element. The drive transistor operates in the saturation region when the data voltage applied to the control terminal by the data line drive circuit is in a first range (range determined so that the transistor 21 operates in the saturation region), and operates in the triode region when the data voltage is in a second range (range determined so that the transistor 21 operates in the triode region). Therefore, it is possible to reduce power supply voltage supplied to the drive transistor and provide a low power consumption display device.

Furthermore, the display device 10 includes, as a measurement circuit, a current measurement circuit (another part of the data line drive/current measurement circuit 14) provided at an outside of the display unit 11 and for measuring the currents Im1 to Im4 flowing through the pixel circuit 20, and the correction unit 16 for correcting the video signal VS1 to be supplied to the data line drive circuit, based on the currents Im1 to Im4 measured by the current measurement circuit. The correction unit 16 determines in which operation region the drive transistor operates between the saturation region and the triode region with respect to each pixel circuit 20 based on the video signal VS1, and corrects the video signal VS1 in accordance with the operation region of the drive transistor. In the display device 10, the operation region of the drive transistor is determined with respect to each pixel circuit 20 based on the video signal VS1, and the video signal VS1 is corrected in accordance with the operation region of the drive transistor. Therefore, it is possible to reduce the power supply voltage supplied to the drive transistor, while correcting in a manner similar to that in a case where the drive transistor operates only in the saturation region. With this, a high image quality and low power consumption display device can be provided.

Furthermore, the correction unit 16 obtains characteristics of the drive transistor and the electro-optical element with respect to each pixel circuit 20 based on the currents Im1 to Im4 measured by the current measurement circuit, and corrects the video signal VS1 in accordance with the operation region of the drive transistor using the characteristics of the drive transistor and the electro-optical element. By obtaining the characteristics of the drive transistor and the electro-optical element with respect to each pixel circuit 20 and correcting the video signal VS1 using these values, it is possible to compensate for variation and fluctuation of the characteristics of the drive transistor and the electro-optical element and perform high image quality display.

Furthermore, the correction unit 16 obtains the first voltage $\text{Vdata}\mathbf{1}_{TFT}$ to be applied to the drive transistor and the second voltage $\text{Vdata}\mathbf{1}_{OLED}$ to be applied to the electro-optical element, based on the code value CV0 included in the video signal VS1 (steps S102, S104), corrects the second voltage $\text{Vdata}\mathbf{1}_{OLED}$ using the characteristics of the electro-optical element (threshold voltage $\text{Vth}_{OLED}$ and gain $\beta_{OLED}$), corrects the first voltage $\text{Vdata}\mathbf{1}_{TFT}$ in accordance with the operation region of the drive transistor using the characteristics of the drive transistor (threshold voltage $\text{Vth}_{TFT}$ and gain $\beta_{TFT}$), and obtains the code value CV corresponding the sum of the corrected first voltage $\text{Vdata}\mathbf{2}_{TFT}$ and the corrected second voltage $\text{Vdata}\mathbf{2}_{OLED}$. It is possible to obtain the voltage $\text{Vdata}\mathbf{1}_{TFT}$ to be applied to the drive transistor and the voltage $\text{Vdata}\mathbf{1}_{OLED}$ to be applied to the electro-optical element based on the code value CV0 included in the video signal VS1, and correct the former voltage in accordance with the operation region of the drive transistor.

Furthermore, the correction unit 16 determines the operation region of the drive transistor based on the first voltage $Vdata1_{TFT}$ and the corrected second voltage $Vdata2_{OLED}$, after correcting the second voltage $Vdata1_{OLED}$. The operation region of the drive transistor can be suitably determined, by determining the operation region of the drive transistor based on the result $Vdata2_{OLED}$ obtained by correcting the voltage to be applied to the electro-optical element.

Furthermore, the current measurement circuit measures the currents Im1, Im2 flowing through the drive transistor when a plurality of measurement voltages (first and second measurement voltages Vm1, Vm2) are written to the pixel circuit 20 in a switching manner, and measures the currents Im3, Im4 flowing through the electro-optical element when another plurality of the measurement voltages (third and fourth measurement voltages Vm3, Vm4) are written to the pixel circuit 20 in a switching manner. The correction unit 16 obtains the threshold voltage $Vth_{TFT}$ and the gain $\beta_{TFT}$ of the drive transistor and the threshold voltage $Vth_{OLED}$ and the gain $\beta_{OLED}$ of the electro-optical element with respect to each pixel circuit 20 based on the currents Im1 to Im4 measured by the current measurement circuit. By measuring the current flowing through the drive transistor or the electro-optical element when the measurement voltage is written, and obtaining the threshold voltage and the gain of the drive transistor and the electro-optical element based on the measurement result, I-V characteristics of the drive transistor and the electro-optical element can be obtained. It is possible to perform high image quality display by correcting the video signal VS1 using the threshold voltage and the gain of the drive transistor and the electro-optical element.

Furthermore, the pixel circuit 20 includes a write control transistor 22 having a first conduction terminal connected to the data line Sj, a second conduction terminal connected to the control terminal of the drive transistor, and a control terminal connected to a first scanning line GAi in the scanning lines GA1 to GAn, GB1 to GBn, and a read control transistor 23 having a first conduction terminal connected to the data line Sj, a second conduction terminal connected to a connection point of the drive transistor and the electro-optical element, and a control terminal connected to a second scanning line GBi in the scanning lines GA1 to GAn, GB1 to GBn. The current measurement circuit is connected to the data line Sj, and measures a current flowing through the pixel circuit 20 and the data line Sj. It is possible to measure the current flowing through the pixel circuit 20 using the current measurement circuit connected to the data line Sj.

Variant of First Embodiment

In the display device 10 according to the first embodiment, since the operation region of the transistor 21 is switched, it is especially required to keep the power supply voltage constant in order to perform high image quality display. For example, when the low-level power supply voltage ELVSS applied to a cathode of a display panel including the display unit 11 fluctuates due to a voltage drop at a wiring line and differs between when displaying a screen close to white and when displaying a screen close to black, a display screen may be unstable.

Figure 9:
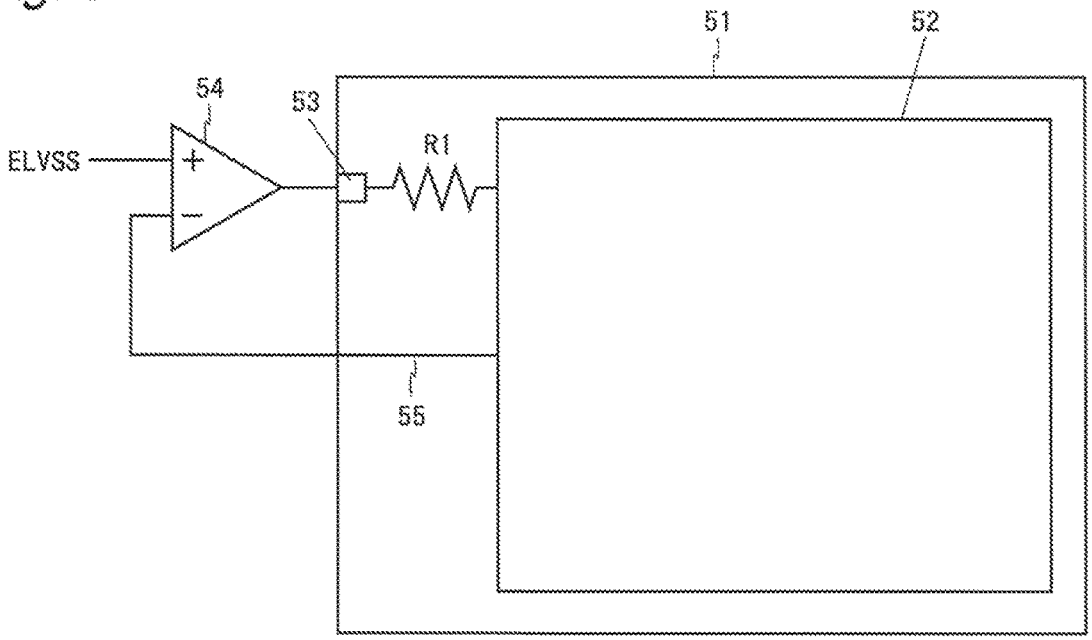
FIG. 9 is a diagram showing a configuration of a power supply circuit of a display device according to a variant of the first embodiment of the present invention.

FIG. 9 is a diagram showing a configuration of a power supply circuit of a display device according to a variant of the first embodiment. FIG. 9 depicts a circuit for supplying the low-level power supply voltage ELVSS to pixel circuits (not shown) in a display panel 51. A cathode 52 common to all of the pixel circuits (not shown) and a pad 53 for supplying the low-level power supply voltage ELVSS are provided to the display panel 51. An operational amplifier 54 is provided at an outside of the display panel 51. The low-level power supply voltage ELVSS is applied to a non-inverting input terminal of the operational amplifier 54. An inverting input terminal of the operational amplifier 54 is connected to the cathode 52 via a feedback line 55. An output terminal of the operational amplifier 54 is connected to the pad 53.

When the low-level power supply voltage ELVSS is applied to the cathode 52, a voltage of the cathode 52 is lowered by a resistance R1 of a wiring connecting the pad 53 and the cathode 52 and a resistance of the cathode 52 by itself. Since the resistance of the cathode 52 is smaller than the resistance R1, the main reason for lowering the low-level power supply voltage ELVSS is the resistance R1. In FIG. 9, since the feedback line 55 has a high impedance, a current does not almost flow through the feedback line 55. Thus, it is possible to apply an output voltage of the operational amplifier 54 to the cathode 52, while feedbacking a voltage of the cathode 52 correctly. Therefore, it is possible to keep the voltage of the cathode 52 constant irrespective of a status of the display screen, and prevent the display screen from being unstable when the operation region of the transistor 21 is switched.

As described above, in the display device according to the variant, the display unit includes a power supply electrode (cathode 52) for supplying a power supply voltage (low-level power supply voltage ELVSS) to the pixel circuit. The display device includes the operational amplifier 54 having the non-inverting input terminal to which the power supply voltage is applied, the inverting input terminal connected to the power supply electrode, and the output terminal connected to the power supply electrode. Even when the operation region of the drive transistor is switched, it is possible to prevent the display screen from being unstable due to fluctuation of the power supply voltage, by controlling the power supply voltage stable using the operational amplifier 54.

In FIG. 9, the operational amplifier 54 is provided to the cathode 52 for supplying the low-level power supply voltage ELVSS to the pixel circuit. The operational amplifier may be provided, in a similar manner, to an anode for supplying the high-level power supply voltage ELVDD to the pixel circuit.

Second Embodiment

In the first embodiment, described is a case where the drive transistor operates both in the saturation region and in the triode region in the display device having the pixel circuit 20 shown in FIG. 2. In display devices having other pixel circuits, the drive transistor may operate both in the saturation region and in the triode region. Display devices having other pixel circuits will be described in the second and third embodiments.

Figure 10:
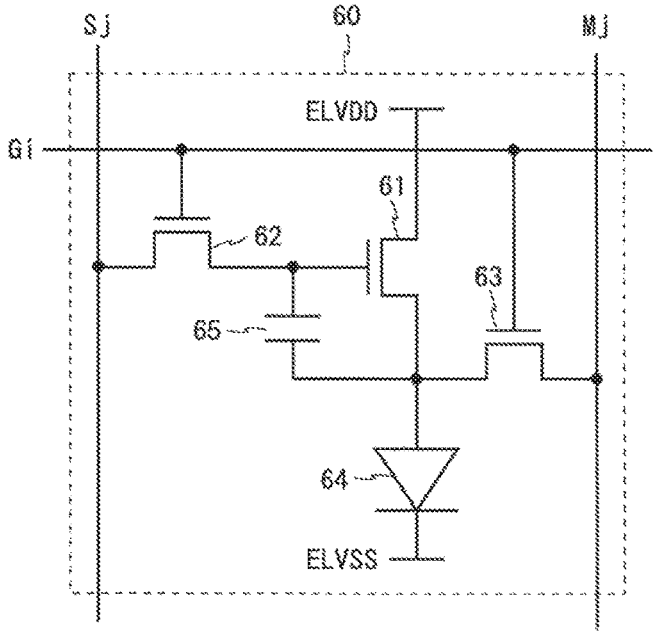
FIG. 10 is a circuit diagram of a pixel circuit of a display device according to a second embodiment of the present invention.

FIG. 10 is a circuit diagram of a pixel circuit in a display device according to a second embodiment of the present invention. FIG. 10 depicts a pixel circuit 60 in the i-th row and the j-th column. As shown in FIG. 10, the pixel circuit 60 in the i-th row and the j-th column includes transistors 61 to 63, an organic EL element 64, and a capacitor 65, and is connected to the scanning line Gi, the data line Sj, and a monitor line Mj. The transistors 61 to 63 are N-channel type TFTs. The pixel circuit 60 is the same as that disclosed in FIG. 22 of International Publication No. 2007/90287.

The high-level power supply voltage ELVDD is applied to a drain terminal of the transistor 61. A source terminal of the transistor 61 is connected to an anode terminal of the organic EL element 64. The low-level power supply voltage ELVSS is applied to a cathode terminal of the organic EL element 64. One conduction terminal (left-side terminal in FIG. 10) of the transistor 62 is connected to the data line Sj, and other conduction terminal of the transistor 62 is connected to a gate terminal of the transistor 61. One conduction terminal (right-side terminal in FIG. 10) of the transistor 63 is connected to the monitor line Mj, and other conduction terminal of the transistor 63 is connected to the source terminal of the transistor 61 and the anode terminal of the organic EL element 64. Gate terminals of the transistors 62, 63 are connected to the scanning line Gi. The capacitor 65 is provided between the gate terminal and the source terminal of the transistor 61. The transistors 61 to 63 function as a drive transistor, a write control transistor, and a read control transistor, respectively.

The display device according to the present embodiment has a configuration similar to that of the display device 10 according to the first embodiment (refer to FIG. 1). However, a display unit of the display device according to the present embodiment includes the n scanning lines G1 to Gn, the m data lines S1 to Sm, m monitor lines M1 to Mm, and (m×n) pieces of the pixel circuits 60. Furthermore, the display device according to the present embodiment includes a data line drive circuit and a current measurement circuit in a separate manner, in place of the data line drive/current measurement circuit 14. The data line drive circuit is connected to the data lines S1 to Sm and drives the data lines S1 to Sm based on the control signal CS2 and the video signal VS2. The current measurement circuit is connected to the monitor lines M1 to Mm and measures a current flowing through the pixel circuit 60 and the monitor line Mj.

Figure 11:
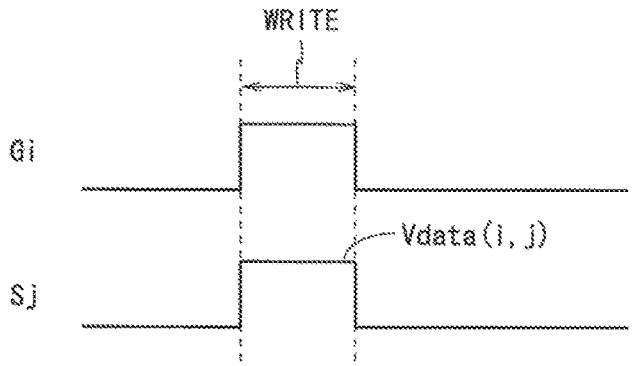
FIG. 11 is a timing chart of the display device according to the second embodiment of the present invention.

Hereinafter, a signal on the scanning line Gi is referred to as scanning signal Gi. When writing, the scanning signal Gi becomes the high level, and the data voltage Vdata(i,j) to be written to the pixel circuit 60 in the i-th row and the j-th column is applied to the data line Sj (refer to FIG. 11). When detecting the characteristics of the drive transistor, the scanning signal Gi becomes the high level, and a voltage with which the transistor 61 turns on and a current does not flow through the organic EL element 64 is applied to the data line Sj and the monitor line Mj as the first and second measurement voltages Vm1, Vm2. When detecting the characteristics of the organic EL element, the scanning signal Gi becomes the high level, and a voltage with which the transistor 61 turns off and a current flows through the organic EL element 64 is applied to the data line Sj and the monitor line Mj as the third and fourth voltages Vm3, Vm4.

Also according to the display device of the present embodiment, as with the first embodiment, the correction unit (not shown) determines in which operation region the transistor 61 operates between the saturation region and the triode region with respect to each pixel circuit 60 based on the video signal VS1, and corrects the video signal VS1 in accordance with the operation region of the transistor 61. However, in the display device according to the present embodiment, when detecting the characteristics of the drive transistor and when detecting the characteristics of the organic EL element, the transistor 63 turns on, and the voltage of the anode terminal of the organic EL element 64 is reset to a voltage applied to the monitor line Mj. Thus, in the correction processing shown in FIG. 6, the correction unit of the display device according to the present embodiment performs a step for using the corrected voltage value $Vdata2_{TFT}$ obtained in step S106 or S107 as it is as the voltage value Vdata, in place of step S108.

As described above, in the display device according to the present embodiment, the display unit includes a plurality of the monitor lines M1 to Mm. The pixel circuit 60 includes the write control transistor 62 having a first conduction terminal connected to the data line Sj, a second conduction terminal connected to a control terminal (gate terminal) of the drive transistor (transistor 61), and a control terminal connected to the scanning line Gi, and the read control transistor 63 having a first conduction terminal connected to the monitor line Mj, a second conduction terminal connected to a connection point of the drive transistor and the electro-optical element (organic EL element 64), and a control terminal connected to the scanning line Gi. The current measurement circuit is connected to the monitor lines M1 to Mm, and measures the current flowing through the pixel circuit 60 and the monitor line Mj. It is possible to measure the current flowing through the pixel circuit 60 using the current measurement circuit connected to the monitor line Mj, and attain the same effects as those attained by the display device 10 according to the first embodiment.

Third Embodiment

Figure 12:
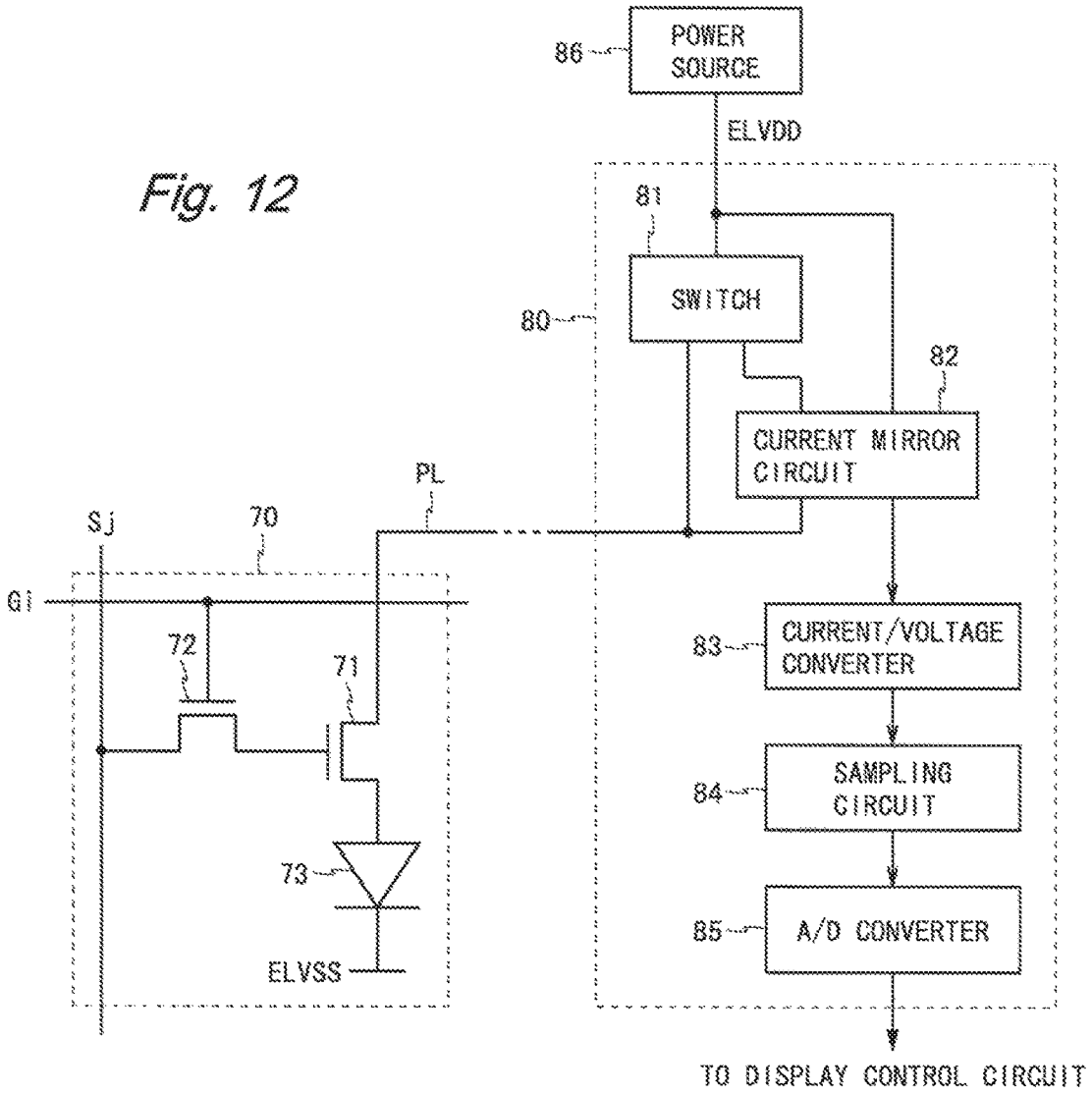
FIG. 12 is a diagram showing a pixel circuit and a current measurement circuit of a display device according to a third embodiment of the present invention.

FIG. 12 is a diagram of a pixel circuit and a current measurement circuit of a display device according to a third embodiment of the present invention. FIG. 12 depicts a pixel circuit 70 in the i-th row and the j-th column and a current measurement circuit 80. The circuit shown in FIG. 12 is obtained by removing some components from a circuit disclosed in FIGS. 2 and 3 of International Publication No. 2010/101761.

As shown in FIG. 12, the pixel circuit 70 in the i-th row and the j-th column includes transistors 71, 72 and an organic EL element 73, and is connected to the scanning line Gi and the data line Sj. The transistors 71, 72 are N-channel type TFTs. A drain terminal of the transistor 71 is connected to a power supply line PL for supplying the high-level power supply voltage ELVDD. A source terminal of the transistor 71 is connected to an anode terminal of the organic EL element 73. The low-level power supply voltage ELVSS is applied to a cathode terminal of the organic EL element 73. One conduction terminal (left-side terminal in FIG. 12) of the transistor 72 is connected to the data line Sj, and the other conduction terminal of the transistor 72 is connected to a gate terminal of the transistor 71. A gate terminal of the transistor 72 is connected to the scanning line Gi. The transistors 71, 72 function as a drive transistor and a write control transistor, respectively.

The display device according to the present embodiment has a configuration similar to that of the display device 10 according to the first embodiment (refer to FIG. 1). However, the display unit of the display device according to the present embodiment includes the n scanning lines G1 to Gn, the m data lines S1 to Sm, and (m×n) pieces of the pixel circuits 70. The display device according to the present embodiment includes a data line drive circuit (not shown) and the current measurement circuit 80 in a separate manner, in place of the data line drive/current measurement circuit 14. The data line drive circuit is connected to the data lines S1 to Sm and drives the data lines S1 to Sm based on the control signal CS2 and the video signal VS2. The current measurement circuit 80 is connected to the power supply line PL and measures a current flowing through the pixel circuit 70 and the power supply line PL.

As shown in FIG. 12, the current measurement circuit 80 includes a switch 81, a current mirror circuit 82, a current/voltage converter 83, a sampling circuit 84, and an A/D converter 85. The high-level power supply voltage ELVDD is supplied from a power source 86 to the current measurement circuit 80. The switch 81 directly applies the high-level power supply voltage ELVDD to the power supply line PL except when measuring the current, and applies the high-level power supply voltage ELVDD to the power supply line PL via the current mirror circuit 82 when measuring the current.

The current mirror circuit 82 outputs, to the current/voltage converter 83, a mirror current an amount of which is the same as that of the current flowing through the power supply line PL and the pixel circuit 70 when measuring the current. The current/voltage converter 83 converts the mirror current output from the current mirror circuit 82 to a voltage. The sampling circuit 84 samples an output signal of the current/voltage converter 83. The sampling circuit 84 includes two sample hold circuits and an operational amplifier, for example, and samples the output signal of the current/voltage converter 83 using a correlation double sampling method. The A/D converter 85 converts an output signal (analog signal) of the sampling circuit 84 to a digital signal. The digital signal obtained by the A/D converter 85 is output to a display control circuit.

When a sufficiently high voltage is applied to the gate terminal of the transistor 71, a resistance of the transistor 71 becomes small so as to be ignorable compared to a resistance of the organic EL element 73. Therefore, when the sufficiently high voltage is applied to the gate terminal of the transistor 71, characteristics of the organic EL element 73 can be obtained based on the measured current. Furthermore, it is possible to obtain summed characteristics (hereinafter referred to as sum characteristics) of characteristics of the transistor 71 and the characteristics of the organic EL element 73, based on the current measured when a voltage with which the transistor 71 operates in the saturation region is applied to the gate terminal of the transistor 71. The characteristics of the transistor 71 can be obtained, by subtracting the characteristics of the organic EL element 73 based on the measured current from the sum characteristics.

Note that when change of the characteristics of the organic EL element 73 is sufficiently small compared to change of the characteristics of the transistor 71, the characteristics of the organic EL element 73 may be regarded as constant. In this case, the characteristics of the transistor 71 can be obtained by subtracting the characteristics of the organic EL element 73 which is fixedly determined in advance from the sum characteristics.

Also according to the display device of the present embodiment, as with the first embodiment, the correction unit (not shown) determines in which operation region the transistor 71 operates between the saturation region and the triode region with respect to each pixel circuit 70 based on the video signal VS1, and corrects the video signal VS1 in accordance with the operation region of the transistor 71.

As described above, in the display device according to the present embodiment, the display unit includes the power supply line PL. The pixel circuit 70 includes the write control transistor 72 having a first conduction terminal connected to the data line Sj, a second conduction terminal connected to a control terminal (gate terminal) of a drive transistor (transistor 71), and a control terminal connected to the scanning line Gi. A first conduction terminal of the drive transistor is connected to the power supply line PL. The current measurement circuit 80 is connected to the power supply line PL and measures the current flowing through the pixel circuit 70 and the power supply line PL. It is possible to measure the current flowing through the pixel circuit 70 using the current measurement circuit 80 connected to the power supply line PL and attain the effects similar to those attained by the display device 10 according to the first embodiment.

Fourth Embodiment

Figure 13:
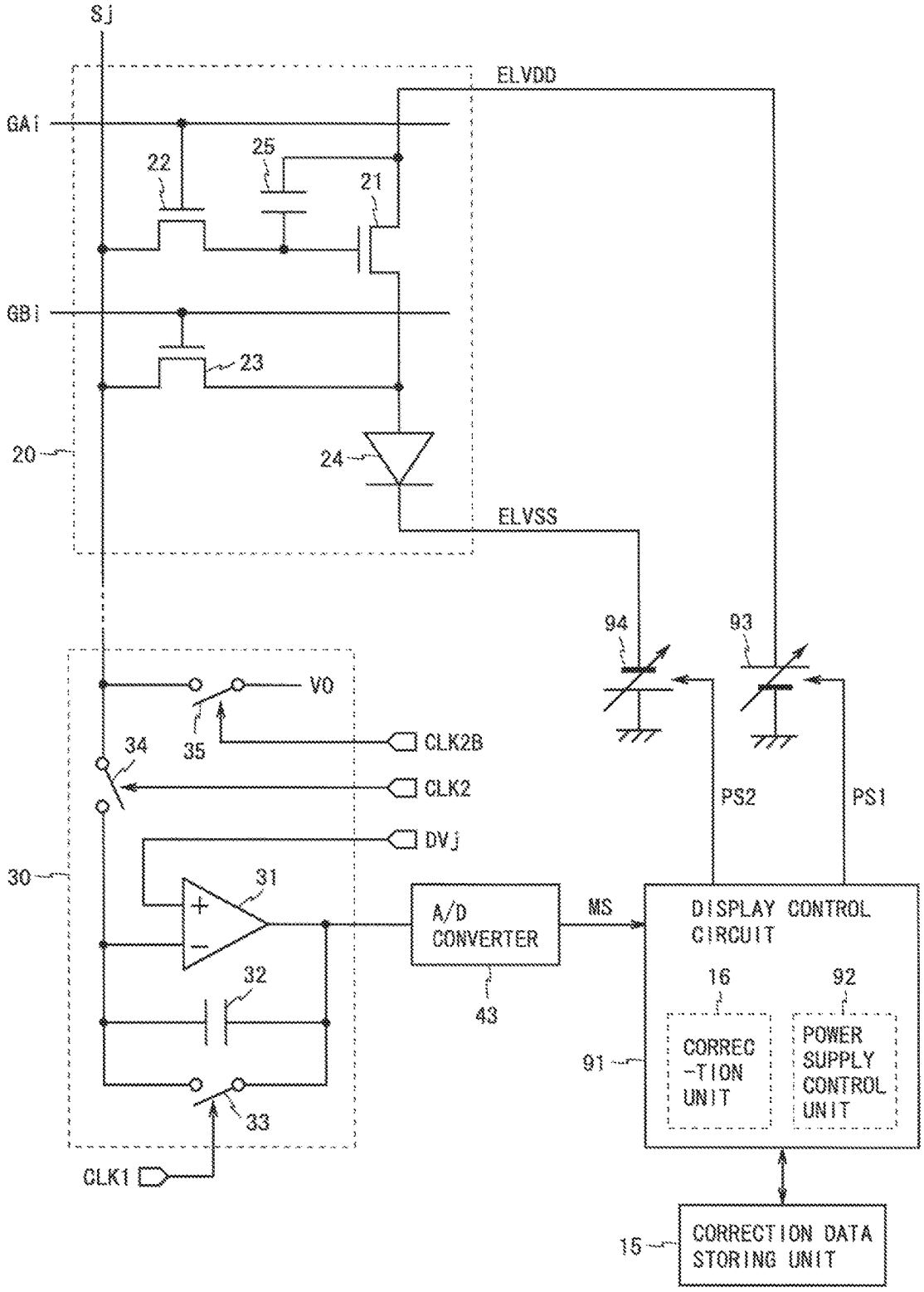
FIG. 13 is a diagram showing a configuration of a power supply circuit of a display device according to a fourth embodiment of the present invention.

A display device according to a fourth embodiment of the present invention is obtained by adding a function of controlling a level of a power supply voltage to the display device 10 according to the first embodiment. FIG. 13 is a diagram showing a configuration of a power supply circuit of a display device according to the fourth embodiment of the present invention. Note that, components which are unnecessary for understanding the features of the present embodiment are not shown in FIG. 13.

In FIG. 13, a variable power source 93 is a power supply for supplying the high-level power supply voltage ELVDD to the pixel circuit 20. A variable power source 94 is a power supply for supplying the low-level power supply voltage ELVSS to the pixel circuit 20. Levels of output voltages of the variable power sources 93, 94 change in accordance with control signals PS1, PS2 output from a display control circuit 91, respectively.

The display control circuit 91 is obtained by adding a power supply control unit 92 to the display control circuit 12 according to the first embodiment. The power supply control unit 92 controls the high-level power supply voltage ELVDD and the low-level power supply voltage ELVSS so that an output amplitude of the data line drive circuit when displaying a maximum gradation is at its maximum, by outputting the control signals PS1, PS2. Furthermore, the power supply control unit 92 controls the high-level power supply voltage ELVDD and the low-level power supply voltage ELVSS in accordance with brightness setting by a user and features of a display image, so that the power supply voltage (ELVDD−ELVSS) is small. For example, when the user selects that a screen is controlled to be dark, the power supply control unit 92 reduces the power supply voltage (ELVDD−ELVSS) by lowering the high-level power supply voltage ELVDD, heightening the low-level power supply voltage ELVSS high, or performing both. Furthermore, when displaying a still image and a maximum gradation included in the still image is lower than a maximum gradation which can be displayed by the display device, the power supply control unit 92 reduces the power supply voltage (ELVDD−ELVSS) in a similar manner.

As described above, the display device according to the present embodiment includes the power supply control unit 92 for controlling the level of the power supply voltage supplied to the pixel circuit 20. According to the display device of the present embodiment, power consumption of the display device can be further reduced by reducing the power supply voltage (ELVDD−ELVSS) supplied to the drive transistor (transistor 21) in accordance with a situation.

Fifth Embodiment

In the first to fourth embodiments, display devices including a current measurement circuit for measuring a current with respect to a pixel circuit have been described. In a fifth embodiment, a display device including a voltage measurement circuit for measuring a voltage with respect to a pixel circuit will be described.

Figure 14:
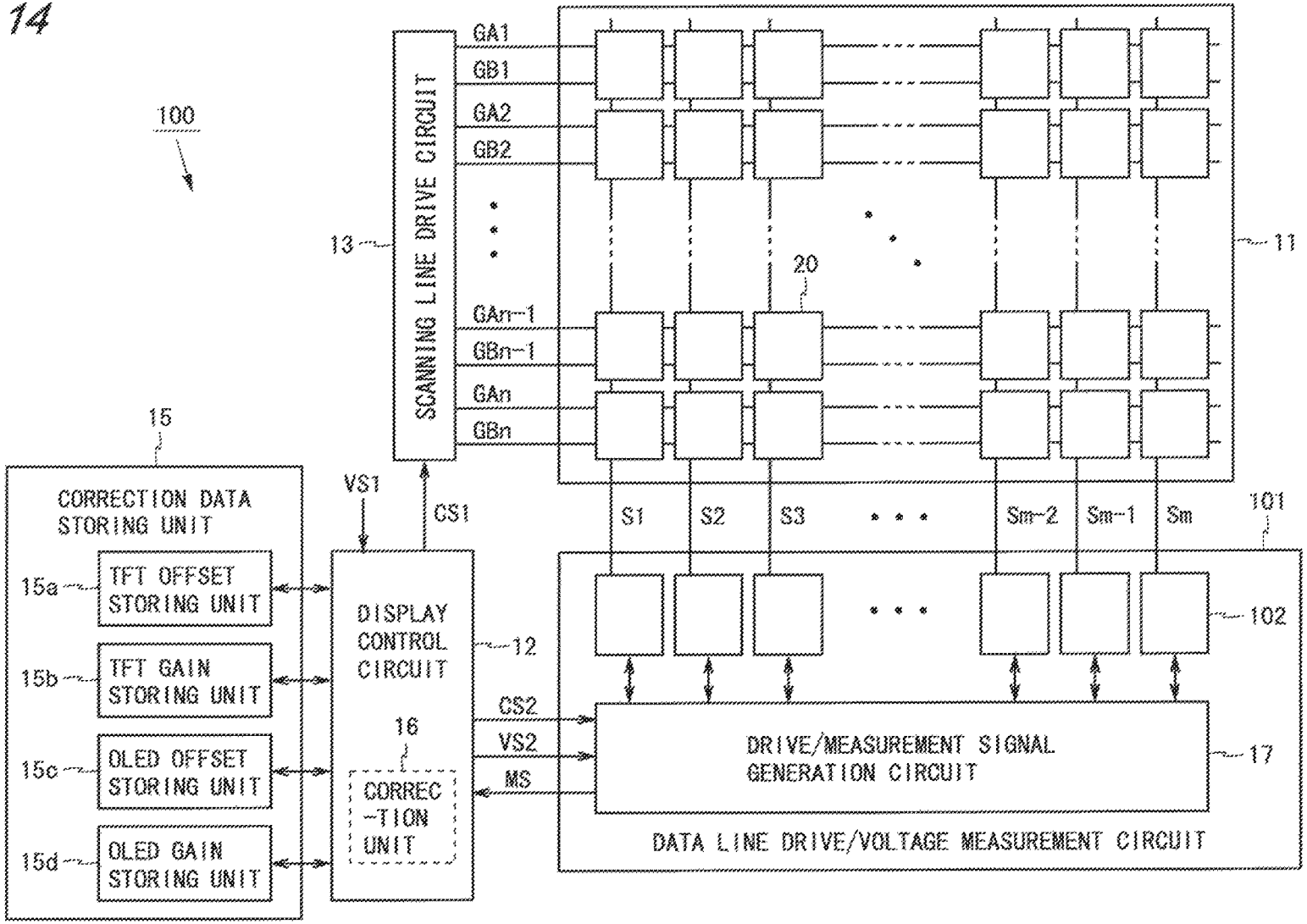
FIG. 14 is a block diagram showing a configuration of a display device according to a fifth embodiment of the present invention.

FIG. 14 is a block diagram showing a configuration of a display device according to a fifth embodiment of the present invention. A display device 100 shown in FIG. 14 is obtained based on the display device 10 (FIG. 1) according to the first embodiment by replacing the data line drive/current measurement circuit 14 with a data line drive/voltage measurement circuit 101 (a combined circuit of a data line drive circuit and a voltage measurement circuit). The data line drive/voltage measurement circuit 101 includes the drive/measurement signal generation circuit 17 and m output/measurement circuits 102.

Figure 15:
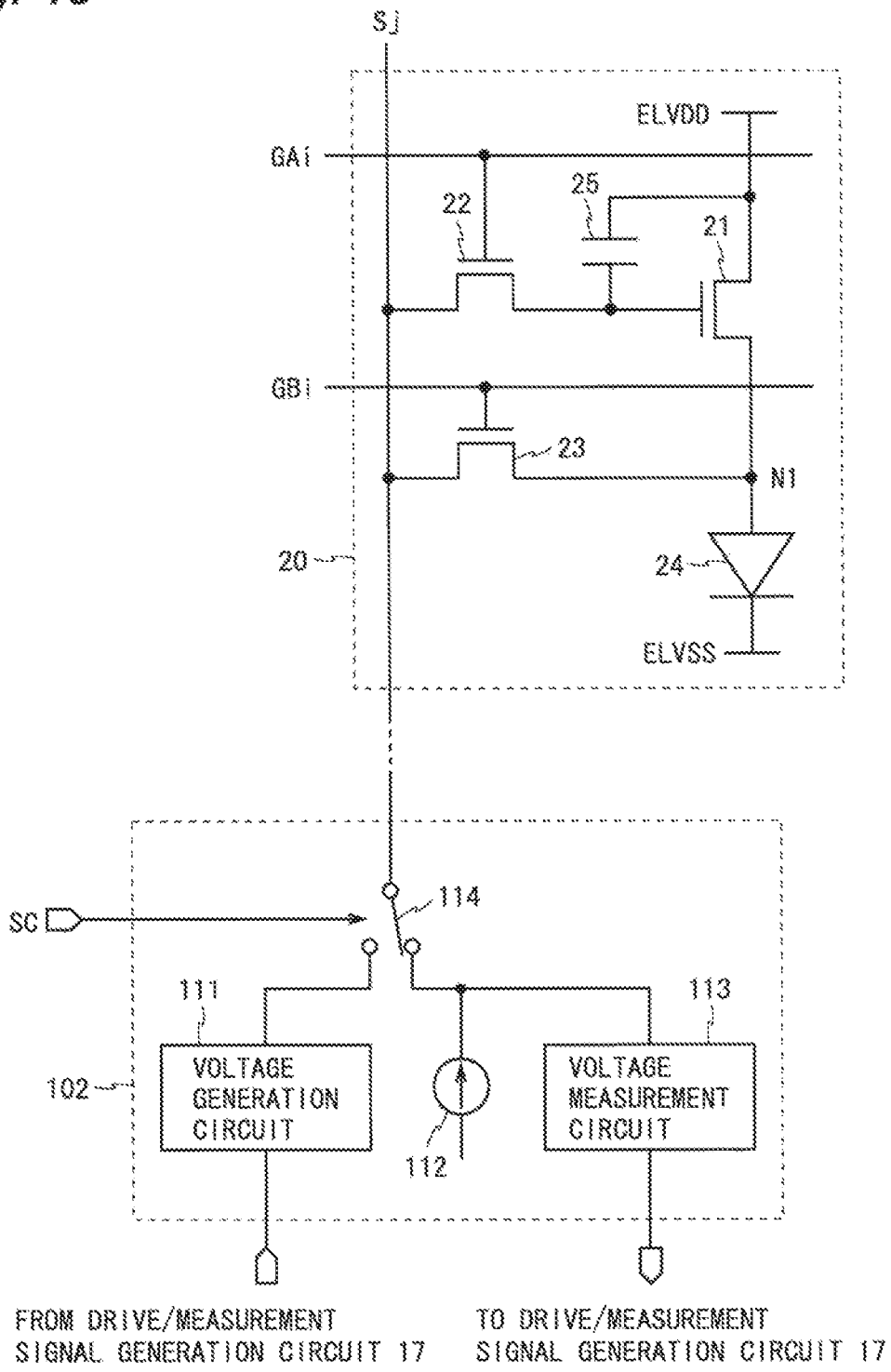
FIG. 15 is a diagram showing a configuration of a pixel circuit and an output/measurement circuit of the display device shown in FIG. 14.

FIG. 15 is a diagram showing a configuration of the pixel circuit 20 and the output/measurement circuit 102. FIG. 15 depicts the pixel circuit 20 in the i-th row and the j-th column and an output/measurement circuit 102 corresponding to the data line Sj. A configuration of the pixel circuit 20 is the same as that of the first embodiment. Hereinafter, a node to which the source terminal of the transistor 21 and the anode terminal of the organic EL element 24 is referred to as N1.

The output/measurement circuit 102 includes a voltage generation circuit 111, a current source 112, a voltage measurement circuit 113, and a switch 114. One end of the switch 114 is connected to the data line Sj. The switch 114 switches whether the data line Sj is connected to the voltage generation circuit 111 or to the current source 112 and the voltage measurement circuit 113, in accordance with a switch control signal SC.

The voltage generation circuit 111 outputs a data voltage based on the digital data output from the drive/measurement signal generation circuit 17, or outputs a reference voltage. When the data line Sj is connected to the voltage generation circuit 111, the data voltage or the reference voltage output from the voltage generation circuit 111 is applied to the data line Sj. When the data line Sj is connected to the current source 112 and the voltage measurement circuit 113, the current source 112 makes a predetermined amount of current flow to the data line Sj, and the voltage measurement circuit 113 measures a voltage of the data line Sj at that time.

In order to correct the video signal VS1 to obtain the video signal VS2, the data line drive/voltage measurement circuit 101 measures four kinds of voltages with respect to each pixel circuit 20. More specifically, in order to obtain the characteristics of the transistor 21 in each pixel circuit 20, the data line drive/voltage measurement circuit 101 measures a voltage Vn1 of the node N1 when a reference voltage with which the transistor 21 turns on is written to the pixel circuit 20 and a first measurement current In1 flows from the current source 112, a voltage Vn2 of the node N1 when a voltage with which the transistor 21 turns on is written to the pixel circuit 20 and a second measurement current In2 (>In1) flows from the current source 112, a voltage Vn3 of the node N1 when a voltage with which the transistor 21 turns off is written to the pixel circuit 20 and a third measurement current In3 flows from the current source 112, and a voltage Vn4 of the node N1 when a voltage with which the transistor 21 turns off is written to the pixel circuit 20 and a fourth measurement current In4 flows from the current source 112.

The scanning line drive circuit 13 and the data line drive/voltage measurement circuit 101 perform a processing for writing to the pixel circuits 20 in one row, and a processing for measuring one of four kinds of the voltages Vn1 to Vn4 with respect to the pixel circuits 20 in one row. For example, in four consecutive frame periods, the scanning line drive circuit 13 and the data line drive/voltage measurement circuit 101 may measure the voltages Vn1 to Vn4 with respect to the pixel circuits 20 in the i-th row in an i-th line period in first to fourth frame periods, respectively, and may perform a processing for writing to the pixel circuits 20 in one row in other line periods.

The correction unit 16 performs a processing for obtaining the characteristics of the transistor 21 and the organic EL element 24 based on the measured four kinds of the voltages Vn1 to Vn4, and corrects the video signal VS1 based on the obtained two kinds of characteristics. More specifically, the correction unit 16 obtains the threshold voltage and the gain as the characteristics of the transistor 21 based on two kinds of the voltages Vn1, Vn2, and obtains the threshold voltage and the gain as the characteristics of the organic EL element 24 based on the two kinds of the voltages Vn3, Vn4. The method for obtaining the threshold voltage and the gain of the transistor 21 and the threshold voltage and the gain of the organic EL element 24 is the same as that in the first embodiment. The correction unit 16 writes the obtained threshold voltage and the obtained gain to the correction data storing unit 15, and corrects the video signal VS1 using the threshold voltage and the gain read from the correction data storing unit 15.

As described above, the display device 100 according to the present embodiment includes, as a measurement circuit in place of the current measurement circuit, the voltage measurement circuit 113 provided at an outside of the display unit 11 and for measuring the voltages Vn1 to Vn4 of the node N1 in the pixel circuit 20, and includes the correction unit 16 for correcting the video signal VS1 to be supplied to the data line drive circuit (data line drive/voltage measurement circuit 101), based on the voltages Vn1 to Vn4 measured by the voltage measurement circuit 113.

Furthermore, the voltage measurement circuit 113 measures the voltages Vn1, Vn2 of one conduction terminal of the drive transistor (source terminal of the transistor 21) when a plurality of measurement currents (first and second measurement currents In1, In2) flow through the pixel circuit 20 in a switching manner, and the voltages Vn3, Vn4 of one terminal of the electro-optical element (anode terminal of the organic EL element 24) when another plurality of measurement currents (third and fourth currents In3, In4) flow through the pixel circuit 20 in a switching manner. The correction unit 16 obtains the threshold voltage $Vth_{TFT}$ and the gain $\beta T_{FT}$ of the drive transistor and the threshold voltage $Vth_{OLED}$ and the gain $\beta_{OLED}$ of the electro-optical element with respect to each pixel circuit 20 based on the voltages Vn1 to Vn4 measured by the voltage measurement circuit 113.

Furthermore, the pixel circuit 20 includes the write control transistor 22 having a first conduction terminal connected to the data line Sj, a second conduction terminal connected to a control terminal of the drive transistor, and a control terminal connected to a first scanning line GAi in the scanning lines GA1 to GAn, GB1 to GBn, and the read control transistor 23 having a first conduction terminal connected to the data line Sj, a second conduction terminal connected to a connection point of the drive transistor and the electro-optical element, and a control terminal connected to a second scanning line GBi in the scanning lines GA1 to GAn, GB1 to GBn. The voltage measurement circuit 113 is connected to the data line Sj and measures the voltage of the connection point of the drive transistor and the electro-optical element (connection point of the transistor 21 and the organic EL element 24).

According to the display device 100 of the present embodiment, effects similar to that attained by the display device 10 according to the first embodiment can be attained.

So far, the display devices according to the first to fifth embodiments and their variants have been described. By combining features of the display devices described so far, unless contrary to its nature thereof, it is possible to configure the display devices according to various kinds of variants. For example, one of the power supply circuits shown in FIGS. 9 and 13 may be added to the display device according to the second or third embodiment.

As described above, according to the display device of the present invention, it is possible to reduce the power supply voltage supplied to the drive transistor and reduce power consumption of the display device by controlling the drive transistor to operate both in the saturation region and in the triode region. Furthermore, it is possible to reduce the power supply voltage supplied to the drive transistor, while correcting in a manner similar to that in a case where the drive transistor operates only in the saturation region, and provide a high image quality and low power consumption display device, by determining the operation region of the drive transistor with respect to each pixel circuit based on the video signal and correcting the video signal in accordance with the operation region of the drive transistor.

INDUSTRIAL APPLICABILITY

Since the display device of the present invention has a feature that it supports high image quality and low power consumption, it is possible to use the display device as various types of display devices having a pixel circuit including an electro-optical element, such as an organic EL display device.

DESCRIPTION OF REFERENCE CHARACTERS

10, 100: DISPLAY DEVICE
11: DISPLAY UNIT
12, 91: DISPLAY CONTROL CIRCUIT
13: SCANNING LINE DRIVE CIRCUIT
14: DATA LINE DRIVE/CURRENT MEASUREMENT CIRCUIT
15: CORRECTION DATA STORING UNIT
16: CORRECTION UNIT
17: DRIVE/MEASUREMENT SIGNAL GENERATION CIRCUIT
20, 60, 70: PIXEL CIRCUIT
21, 61, 71: TRANSISTOR (DRIVE TRANSISTOR)
22, 62, 72: TRANSISTOR (WRITE CONTROL TRANSISTOR)
23, 63: TRANSISTOR (READ CONTROL TRANSISTOR)
24, 64, 73: ORGANIC EL ELEMENT (ELECTRO-OPTICAL ELEMENT)
25, 32, 65: CAPACITOR
30, 102: OUTPUT/MEASUREMENT CIRCUIT
31, 54: OPERATIONAL AMPLIFIER
33 to 35, 114: SWITCH
40: SIGNAL CONVERSION CIRCUIT
51: DISPLAY PANEL
52: CATHODE
80: CURRENT MEASUREMENT CIRCUIT
92: POWER SUPPLY CONTROL UNIT
101: DATA LINE DRIVE/VOLTAGE MEASUREMENT CIRCUIT
111: VOLTAGE GENERATION CIRCUIT
112: CURRENT SOURCE
113: VOLTAGE MEASUREMENT CIRCUIT
GA1 to GAn, GB1 to GBn: SCANNING LINE
S1 to Sm: DATA LINE
Mj: MONITOR LINE
PL: POWER SUPPLY LINE

The invention claimed is:

1. An active-matrix type display device comprising:
a display unit including a plurality of scanning lines, a plurality of data lines, and a plurality of pixel circuits arranged two-dimensionally;
a scanning line drive circuit configured to drive the scanning lines;
a data line drive circuit configured to drive the data lines;
a measurement circuit provided at an outside of the display unit and configured to measure a current or a voltage with respect to the pixel circuit; and
a correction unit configured to correct a video signal to be supplied to the data line drive circuit, based on the current or the voltage measured by the measurement circuit, wherein
the pixel circuit includes an electro-optical element, and a drive transistor having a control terminal and connected in series with the electro-optical element,
the drive transistor is configured to operate in a saturation region when a data voltage applied to the control terminal using the data line drive circuit is in a first range, and operate in a triode region when the data voltage is in a second range, and
the correction unit is configured to determine in which operation region the drive transistor operates between the saturation region and the triode region with respect to each pixel circuit based on the video signal, and correct the video signal in accordance with the operation region of the drive transistor.

2. The display device according to claim 1, wherein the correction unit is configured to obtain characteristics of the drive transistor and the electro-optical element with respect to each pixel circuit based on the current or the voltage measured by the measurement circuit, and correct the video signal in accordance with the operation region of the drive transistor using the characteristics of the drive transistor and the electro-optical element.

3. The display device according to claim 2, wherein the correction unit is configured to obtain a first voltage to be applied to the drive transistor and a second voltage to be applied to the electro-optical element based on a code value included in the video signal, correct the second voltage using the characteristics of the electro-optical element, correct the first voltage using the characteristics of the drive transistor in accordance with the operation region of the drive transistor, and obtain a code value corresponding to a sum of a corrected first voltage and a corrected second voltage.

4. The display device according to claim 3, wherein the correction unit is configured to determine the operation region of the drive transistor based on the first voltage and the corrected second voltage, after correcting the second voltage.

5. The display device according to claim 1, wherein
the display unit further includes a power supply electrode configured to supply a power voltage to the pixel circuit, and
the display device further comprises an operational amplifier having a non-inverting input terminal to which the power supply voltage is applied, an inverting input terminal connected to the power supply electrode, and an output terminal connected to the power supply electrode.

6. The display device according to claim 1, further comprising a power supply control unit configured to control a level of the power supply voltage to be supplied to the pixel circuit.

7. The display device according to claim 1, wherein the measurement circuit is a current measurement circuit configured to measure a current flowing through the pixel circuit.

8. The display device according to claim 7, wherein the current measurement circuit is configured to measure a current flowing through the drive transistor when a plurality of measurement voltages are written to the pixel circuit in a switching manner, and a current flowing through the electro-optical element when another plurality of measurement voltages are written to the pixel circuit in a switching manner, and the correction unit is configured to obtain a threshold voltage and a gain of the drive transistor and a threshold voltage and a gain of the electro-optical element with respect to each pixel circuit based on the current measured by the current measurement circuit.

9. The display device according to claim 7, wherein the pixel circuit further includes:

a write control transistor having a first conduction terminal connected to the data line, a second conduction terminal connected to the control terminal of the drive transistor, and a control terminal connected to a first scanning line in the scanning lines; and a read control transistor having a first conduction terminal connected to the data line, a second conduction terminal connected to a connection point of the drive transistor and the electro-optical element, and a control terminal connected to a second scanning line in the scanning lines, and the current measurement circuit is connected to the data line and is configured to measure the current flowing through the pixel circuit and the data line.

10. The display device according to claim 7, wherein the display unit further includes a plurality of monitor lines, the pixel circuit further includes:

a write control transistor having a first conduction terminal connected to the data line, a second conduction terminal connected to the control terminal of the drive transistor, and a control terminal connected to the scanning line; and a read control transistor having a first conduction terminal connected to the monitor line, a second conduction terminal connected to a connection point of the drive transistor and the electro-optical element, and a control terminal connected to the scanning line, and the current measurement circuit is connected to the monitor line and is configured to measure the current flowing through the pixel circuit and the monitor line.

11. The display device according to claim 7, wherein the display unit includes a power supply line, the pixel circuit further includes a write control transistor having a first conduction terminal connected to the data line, a second conduction terminal connected to the control terminal of the drive transistor, and a control terminal connected to the scanning line, the first conduction terminal of the drive transistor is connected to the power supply line, and the current measurement circuit is connected to the power supply line and is configured to measure the current flowing through the pixel circuit and the power supply line.

12. The display device according to claim 1, wherein the measurement circuit is a voltage measurement circuit configured to measure a voltage of a node in the pixel circuit.

13. The display device according to claim 12, wherein the voltage measurement circuit is configured to measure a voltage of one conduction terminal of the drive transistor when a plurality of measurement currents flow through the drive transistor in a switching manner, and a voltage of one terminal of the electro-optical element when another plurality of measurement currents flow through the electro-optical element in a switching manner, and the correction unit is configured to obtain a threshold voltage and a gain of the drive transistor and a threshold voltage and a gain of the drive transistor and a threshold voltage and a gain of the electro-optical element with respect to each pixel circuit based on the voltage measured by the voltage measurement circuit.

14. The display device according to claim 13, wherein the pixel circuit further includes:

a write control transistor having a first conduction terminal connected to the data line, a second conduction terminal connected to the control terminal of the drive transistor, and a control terminal connected to a first scanning line in the scanning lines; and a read control transistor having a first conduction terminal connected to the data line, a second conduction terminal connected to a connection point of the drive transistor and the electro-optical element, and a control terminal connected to a second scanning line in the scanning lines, and the voltage measurement circuit is connected to the data line and is configured to measure a voltage at the connection point of the drive transistor and the electro-optical element.

15. A drive method for an active-matrix type display device including a display unit having a plurality of scanning lines, a plurality of data lines, and a plurality of pixel circuits arranged two-dimensionally, the method comprising:

driving the scanning lines;

driving the data lines;

measuring a current or a voltage with respect to the pixel circuit at an outside of the display unit; and correcting a video signal to be used for driving the data line, based on a measured current or a measured voltage, wherein the pixel circuit includes an electro-optical element, and a drive transistor having a control terminal and connected in series with the electro-optical element, the drive transistor is configured to operate in a saturation region when a data voltage applied to the control terminal in driving the data lines is in a first range, and operate in a triode region when the data voltage is in a second range, and the correcting includes determining in which operation region the drive transistor operates between the saturation region and the triode region with respect to each pixel circuit based on the video signal, and correcting the video signal in accordance with the operation region of the drive transistor.

* * * * *